US009889686B2

(12) United States Patent
Wander et al.

(10) Patent No.: US 9,889,686 B2
(45) Date of Patent: Feb. 13, 2018

(54) PRINTING ASSEMBLY

(71) Applicant: KOENIG & BAUER AG, Würzburg (DE)

(72) Inventors: Stefan Wander, Helmstadt (DE); Wolfgang Reder, Veitshöchheim (DE); Karl Schäfer, Kürnach (DE)

(73) Assignee: Koenig & Bauer, AG, Wurzburg (DE)

( * ) Notice: Subject to any disclaimer, the term of this patent is extended or adjusted under 35 U.S.C. 154(b) by 0 days.

(21) Appl. No.: 15/531,051

(22) PCT Filed: Nov. 23, 2015

(86) PCT No.: PCT/EP2015/077329
§ 371 (c)(1),
(2) Date: May 26, 2017

(87) PCT Pub. No.: WO2016/091563
PCT Pub. Date: Jun. 16, 2016

(65) Prior Publication Data

US 2017/0320341 A1 Nov. 9, 2017

(30) Foreign Application Priority Data

Dec. 9, 2014 (DE) ..... 10 2014 225 206

(51) Int. Cl.
*B41J 15/04* (2006.01)
*B41J 11/00* (2006.01)

(52) U.S. Cl.
CPC ..... *B41J 15/046* (2013.01); *B41J 11/001* (2013.01)

(58) Field of Classification Search
CPC ..... B41J 15/046; B41J 11/001; B41J 11/006; B41J 11/0065; B41J 11/007;
(Continued)

(56) References Cited

U.S. PATENT DOCUMENTS 4,334,946 A 6/1982 Kanoto
5,793,397 A 8/1998 Barker et al.
(Continued)

FOREIGN PATENT DOCUMENTS

EP 0771652 A1 5/1997
JP 2005-246617 A 9/2005
(Continued)

OTHER PUBLICATIONS

International Search Report of PCT/EP2015/071329 dated Mar. 20, 2016.

*Primary Examiner* — Kristal Feggins
(74) *Attorney, Agent, or Firm* — Mattingly & Malur, PC

(57) ABSTRACT

The invention relates to a printing assembly which has print heads, each of which specifies application positions for printing fluid. A transport path is provided for the printing substrate through the printing assembly and is defined by at least two guide elements of the printing assembly. A printing section of the transport path begins at a first application position and ends at a last application position. At least one of the guide elements is in contact with a total of at least two lateral support elements and with at least one inner support element at three points that are spaced from one another in a transverse direction, the position of that guide element being thereby defined. The inner support element is arranged such that it is or can be rigidly connected to at least one of the lateral support elements. The lateral support elements can be embodied as part of a support frame, which support frame has at least one cross-member that is different from the guide elements, that at least one cross-member extending in the transverse direction and ensuring a constant relative positioning of the lateral support elements.

15 Claims, 13 Drawing Sheets

(58) Field of Classification Search
CPC .... B41J 13/0054; B41J 13/103; B41J 13/106; B41J 13/12; B41J 15/044; B41J 15/048; B41J 15/18; B41J 17/02; B41J 17/18; B41J 17/20; B41J 15/00; B41J 15/16; B65H 75/241
See application file for complete search history.

(56) References Cited

U.S. PATENT DOCUMENTS

| | | | | |
|---|---|---|---|---|
| 7,237,888 | B2 * | 7/2007 | Silverbrook | B41J 11/001 347/102 |
| 9,002,257 | B2 * | 4/2015 | Saiga | B41J 11/70 399/405 |
| 2001/0046405 | A1 * | 11/2001 | Miyazaki | B41J 11/00 400/605 |
| 2010/0245418 | A1 | 9/2010 | Shimizu et al. | |
| 2011/0043554 | A1 | 2/2011 | Silverbrook et al. | |
| 2011/0149004 | A1 | 6/2011 | Ray et al. | |
| 2011/0150552 | A1 | 6/2011 | McLaughlin et al. | |
| 2012/0162299 | A1 | 6/2012 | Chappell | |
| 2014/0176639 | A1 | 6/2014 | Tunmore et al. | |
| 2015/0035888 | A1 | 2/2015 | Kakigahara | |

FOREIGN PATENT DOCUMENTS

| | | |
|---|---|---|
| JP | 2007-147817 | 6/2007 |
| WO | 03/053705 A1 | 7/2003 |

* cited by examiner

PRINTING ASSEMBLY

CROSS-REFERENCE TO RELATED APPLICATIONS

This application is the U.S. National Phase, under 35 U.S.C. § 371, of PCT/EP2015/077329, filed Nov. 23, 2015; published as WO2016/091563A1 on Jun. 16, 2016 and claiming priority to DE 10 2014 225 206.7 filed Dec. 9, 2014, the disclosures of which are expressly incorporated herein by reference.

FIELD OF THE INVENTION

The present invention relates to a printing assembly. The printing assembly has at least two print heads, each of which specifies application positions for printing fluid. A transport path is provided for a printing substrate through the printing assembly and is defined by at least two guide elements of the printing assembly. A printing section of the transport path, which is provided for the printing substrate, begins at a first application position in the printing assembly, continues along that so-provided transport path, and ends at a last application position in the printing assembly along the so-provided transport path. A transverse direction is a horizontal direction, which is oriented orthogonally to the transport path provided for the printing substrate through the at least one printing assembly.

Various printing methods are used in printing machines. Non-impact printing (NIP) methods are understood as printing methods that do not require a fixed, that is, a physically unchanging printing forme. Such printing methods can produce different printed images in each printing process. Examples of non-impact printing methods include ionographic methods, magnetographic methods, thermographic methods, electrophotography, laser printing, and in particular inkjet printing methods. Such printing methods typically have at least at least one image producing device, for example at least one print head. In the case of the inkjet printing method, such a print head is configured, for example, as an inkjet print head and has at least one and preferably a plurality of nozzles, by means of which at least one printing fluid, for example in the form of ink droplets, can be transferred selectively to a printing substrate. In this process, it is important for the distance between the printing substrate and the image producing device to be kept as constant as possible, to allow image production to be synchronized over time, while at the same time avoiding damage to the image producing device.

In the inkjet printing method, for example, particularly when water-based inks are used, the printing substrate can become deformed, for example, forming ripples. Such ripples can entail the risk of damage both to print heads and to the printing substrate, and can also lead to low print quality, for example due to the different flight time lengths for droplets of printing fluid.

US 2012/0162299 A1 discloses a printing assembly that has a plurality of print heads and stationary guide elements in the region of the print heads.

WO 03/03705 A1 discloses a printing assembly that has a row of print heads and web guiding rollers opposite said print heads, said web guiding rollers being arranged such that they can be thrown off of the print heads together in a linear manner.

US 2011/0043554 A1 discloses a printing assembly which has printing units arranged one above the other, for printing respectively different sides of a web of printing substrate. As guide elements, rollers are arranged in a common frame.

EP 0771652 A1 discloses a printing assembly that has a vertical transport path for a printing substrate web in a printing section.

JP 2005-246617 A discloses a printing assembly that has a pivotable guide element.

US 2010/0245418 A1 discloses a printing assembly with guide elements that are movable in a transverse direction.

U.S. Pat. No. 4,334,946 A discloses a printing assembly in which two web fixing devices are arranged together on a movable support body.

Known from JP 2007-147817 A is a printing assembly in which web-type printing substrate is separated into sections, which are then further processed individually.

US 2014/0176639 A1 discloses a printing assembly that has fixed guide elements, against which a printing substrate is partially suctioned by means of a vacuum.

US 2011/0150552 A1 discloses a printing assembly that has a series of guide elements.

SUMMARY OF THE INVENTION

The object of the present invention is to provide a printing assembly.

The object is achieved according to the invention by the provision of at least one of the at least two guide elements, that together define the provided transport path in the region of the printing section, in contact with a total of at least two lateral support elements and at least one inner support element at three points that are spaced from each other in the transverse direction, to thereby define the position of the guide element. The at least one inner support element is or can be rigidly connected to at least one of the at least two lateral support elements. The at least two lateral support elements are embodied as part of at least one support frame. The at least one support frame has at least one cross-member that is different from the guide elements, which at least one cross-member extends at least in the transverse direction and ensures a constant relative positioning of the lateral support elements.

A printing machine preferably has at least one printing assembly. The printing assembly preferably has at least two image producing devices, in particular configured as print heads, each of which determines application positions for printing fluid, with a first transport path, in particular, through the printing assembly, provided for printing substrate, preferably being defined by at least two guide elements of the printing assembly, and said at least two guide elements preferably being at least two preferably stationary guide elements of the printing assembly. A printing section of the transport path provided for printing substrate preferably begins at a first application position in the printing assembly along said provided transport path, and said printing section preferably ends at a last application position along said provided transport path in said printing assembly. Because the guide elements are stationary, they can be particularly easily constructed. It is also possible to achieve very large printing widths without problems with sagging guide elements. A print head is preferably an image producing device for a non-impact printing method, in other words a printing method without a fixed printing forme.

The printing assembly is preferably characterized in that at least two, preferably at least five, more preferably at least eight, even more preferably at least ten, more preferably at least fourteen, and more preferably still at least twenty-eight stationary guide elements, which together define the provided transport path, are arranged one in front of the other along the printing section of said provided transport path. This results in the advantage, in particular, that an especially large number of print heads and thus a high printing speed and a high print quality can be achieved.

A stationary guide element in this case should be understood in particular as a guide element that remains immovable and/or stationary during a printing operation, and/or that is not rotatable by means of its own drive or by contact with printing substrate, and/or that, with respect to rotational movements and/or swiveling movements and/or pivoting movements about axes that are oriented orthogonally to a transport direction of the transport path provided for the printing substrate, is intended at most to execute pivoting movements together with other guide elements about at least one common pivot axis. In particular, the at least one printing assembly is preferably characterized in that the at least two and more preferably the at least five, in particular stationary guide elements are preferably stationary guide elements with respect to swiveling movements or pivoting movements about axes other than at least one pivot axis that is common to them. In this case, a stationary guide element should be understood, in particular, as a guide element that is arranged immovably relative to at least one support element that supports said guide element, at least one additional stationary guide element more preferably being arranged immovably relative to the same at least one support element. In particular, the stationary guide elements are preferably stationary relative to at least one support frame of a pivot device. The support element and/or the support frame itself is preferably arranged movably relative to a stand of the printing assembly. The guide elements that are stationary with respect to swiveling movements about rotational axes are preferably stationary at least with respect to such rotational axes that intersect the respective guide element. Preferably, the stationary guide elements are, in particular, guide elements that are stationary relative to one another.

The feature that at least one guide element is positioned so as to assist in defining a provided transport path preferably means that the provided transport path is defined by the at least one guide element and optionally but not necessarily by additional components of the printing assembly.

Preferably, the printing assembly is alternatively or additionally characterized by the fact that the at least two and more preferably at least five stationary guide elements each have a turning angle of at least 0.5°, more preferably at least 1° and even more preferably at least 1.5°, and of preferably at most 5°, more preferably at most 3°, and even more preferably 2.5° in relation to the transport path provided for the printing substrate. This results, in particular, in the advantage that a particularly flat profile of the printing section of the provided transport path can be achieved, thereby allowing a very large number of print heads to be arranged one in front of the other. In addition, with a small turning angle, friction between the printing substrate and the stationary guide elements, in particular, is reduced.

A transverse direction is preferably a horizontal direction, oriented orthogonally to the transport path provided for printing substrate through the at least one printing assembly. Preferably, the printing assembly is alternatively or additionally characterized by the fact that the at least two, in particular, and preferably at least five stationary guide elements each have a radially symmetrical or even circular cross-section over more than half of their extension in the transverse direction. Radial symmetry or rotational symmetry is understood as a form of symmetry in which the rotation of an object around a certain rotational angle about an axis, in particular an axis of rotation or axis of symmetry, will return said object in alignment with itself. In the case of two-dimensional objects, this axis of rotation or axis of symmetry preferably extends through a centroid of a surface, and in the case of three-dimensional objects it preferably extends through a centroid of the volume of the object in question. Each of the guide elements preferably has a radially symmetrical or even circular cross-section over more than half of its extension in the transverse direction, even if they are configured as non-stationary guide elements.

Reference is preferably to an n-fold radial or rotational symmetry when a rotation about a rotational angle of 360°/n will return the object in alignment with itself. In this case, n is preferably a natural number. Radially symmetrical objects, which are projected onto themselves with a rotation about the axis of rotation or axis of symmetry by any rotational angle, for example cylinders, are not only radially symmetrical, but also rotationally symmetrical. The printing assembly is preferably alternatively or additionally characterized by the fact that an outer surface of each of the at least two, in particular, and preferably at least five guide elements is configured in the shape of a cylindrical shell, at least within a working region of the printing assembly. This results, in particular, in the advantage that, when the surface sections of the guide elements that come into contact with the printing substrate become worn, the guide elements can simply be rotated about a certain, for example predefined angle and then reinstalled or secured, and can then continue to be used. If the turning angle is very small, a particularly large number of possible renewed uses of the web guide elements are obtained. The large number of web guide elements and the small turning angles keep the frictional forces low, thereby minimizing wear on the guide elements. Overall, a very long service life is achieved before guide elements must be replaced due to wear.

Preferably, the printing assembly is alternatively or additionally characterized by the fact that said at least two and preferably at least five guide elements that together define said provided transport path in the region of the printing section are arranged so as to pivot about at least one pivot axis common to them, in particular to move said at least two and preferably at least five guide elements between a respective working position and a respective maintenance position. Preferably, said at least two and preferably at least five guide elements that together define said provided transport path in the region of the printing section are arranged so as to pivot about the at least one pivot axis common to them by means of at least one pivot drive and/or in at least one common movement and/or relative to the at least two print heads. This results, in particular, in the advantage that a maintenance space can be created, in particular for cleaning a shielding device and/or the guide elements. The printing assembly is preferably alternatively or additionally characterized by the fact that said at least two and more preferably at least five guide elements are positioned so as to pivot with a pivot angle of at least 10°, more preferably at least 20° and even more preferably at least 30° about the at least one pivot axis common to them.

Preferably, the printing assembly is alternatively or additionally characterized by the fact that a main conveying direction, which is defined by a rectilinear connection between a first guide element with respect to the printing section of the transport path provided for the printing substrate and a last guide element with respect to the printing section of the transport path provided for printing substrate is oriented orthogonally to the transverse direction, and in that when the guide elements are arranged in their maintenance position, the main conveying direction is disposed at an angle of at most 30°, more preferably at most 20° and even more preferably at most 10° in relation to a vertical direction. This results, in particular, in the advantage that the maintenance space is particularly large, and the guide elements are particularly readily accessible in their maintenance position. In particular, this enables large printing substrate widths or working widths of the printing assembly to be realized.

Preferably, the printing assembly is alternatively or additionally characterized by the fact that, when the guide elements are arranged in their working position, the main conveying direction is aligned at an angle of at least 10°, more preferably at least 20°, and even more preferably at least 30°, and in particular independently thereof, at an angle of at most 70°, more preferably at most 55° and even more preferably at most 40° in relation to a horizontal plane. This results, in particular, in the advantage that even the bottommost print heads are not arranged at an overly steep angle, and that an upward sloping profile of the printing section is nevertheless enabled. The upward slope allows the web to be guided immediately afterward substantially from the top downward through a dryer without bringing turning means into contact with the freshly printed side of the web. Preferably, the printing assembly is alternatively or additionally characterized by the fact that the transport path provided for printing substrate is curved in only one direction, in particular downward, along the printing section. A downward curvature is not at variance with a transport path that extends upward, and instead means, for example, an upward slope that continuously or gradually becomes less steep over the course of the transport path. Preferably, the printing assembly is alternatively or additionally characterized by the fact that the transport path provided for printing substrate is bordered and/or contacted along the printing section on precisely one side by components of the printing assembly, or forms a tangent thereto.

Preferably, the printing assembly is alternatively or additionally characterized by the fact that the at least two print heads each have a plurality of nozzles, and in that further preferably, at least one nozzle of each print head has a target region that intersects at least one and more preferably precisely one of the at least two in particular, and more preferably at least five preferably stationary guide elements. This preferably applies, in particular, when each respective print head is arranged in its printing position and when each respective guide element is arranged in its working position. Preferably, this applies alternatively or additionally to multiple or more preferably to all nozzles of the print head in question. This results, in particular, in the advantage that the printing fluid is applied to the printing substrate in a region in which the latter is particularly flat because it is pulled against the corresponding guide element as a result of the turning angle. Water-based printing fluid, in particular, generally causes the printing substrate to swell, which can lead to deformations, in particular rippling in the printing substrate. This is particularly critical in the case of print images that do not cover the entire surface and/or variable print images. The alignment of the nozzles toward the guide elements and thus toward the flattened regions of the printing substrate reduces and/or prevents printing errors and/or damage to the nozzles, which are positioned only a short distance from the provided transport path. In particular, insofar as such deformations do not occur to an excessive extent, all of the nozzles may have target regions that do not intersect with any of the at least two in particular, and more preferably at least five preferably stationary guide elements, and instead extend exclusively between the guide elements, passing by the guide elements.

Preferably, the printing assembly is alternatively or additionally characterized by the fact that at least one of the at least two and preferably at least five guide elements that together define said provided transport path in the region of the printing section is in contact with a total of at least two lateral support elements and at least one inner support element, at three points that are preferably configured as bearing regions and are spaced from one another in the transverse direction, and as a result, the position of said guide element is defined. Further preferably, the printing assembly is alternatively or additionally characterized by the fact that the at least one inner support element is arranged so as to be rigidly connected and/or connectable to at least one of the at least two lateral support elements. The at least two lateral support elements are preferably embodied as part of at least one support frame. The at least one support frame preferably has at least one cross-member that is different from the guide elements and that extends at least in the transverse direction and ensures a constant relative position of the lateral support elements. For example, the at least one cross-member that is different from the guide elements ensures a constant relative position of the lateral support elements and the at least one inner support element. Preferably, at least two cross-members that are different from the guide elements ensure a constant relative position of the lateral support elements and the at least one inner support element.

Further preferably, the printing assembly is alternatively or additionally characterized by the fact that a plurality, or even more preferably all of the at least two and preferably at least five guide elements that together define said provided transport path in the region of the printing section are in contact with a total of at least two lateral support elements and at least one inner support element at three locations, which are spaced from one another in the transverse direction and are preferably embodied as bearing regions, thereby fixing said guide elements in position, the plurality of guide elements or more preferably all of the guide elements being in contact with the same lateral and/or inner support elements. This also produces a supporting effect on the guide elements between the outer ends of the guide elements; as a result, the guide elements have a decreased tendency, or even no tendency at all, to be deflected by the force of gravity and/or by web tension. Such deflection would otherwise impact the distance between nozzles and printing substrate, in particular. In this manner, high print image quality is ensured, even with large web widths. Preferably, the printing assembly is alternatively or additionally characterized by the fact that the at least one inner support element is in contact with the at least one guide element at a location that is preferably embodied as a bearing region, with the position of said guide element with respect to the transverse direction coinciding with the position of at least one nozzle of at least one print head of the printing assembly.

Preferably, the printing assembly is alternatively or additionally characterized by the fact that at least one threading means for threading in a printing substrate web, which threading means is movable along at least one threading path and is further preferably different from any printing substrate, is and/or can be arranged, at least temporarily, within the at least one printing assembly. This results, in particular, in the advantage that a particularly simple and safe feeding of printing substrate into the printing assembly and/or the printing machine is enabled, which is particularly important in the case of large web widths.

Preferably, the printing assembly is alternatively or additionally characterized by the fact that the printing assembly has at least one in particular immovable stand or machine stand, and in that the printing assembly has the at least one first transport path, which is defined by at least two guide elements together and is provided for webs of printing substrate, and also has at least one support element that is movable, in particular pivotable relative to the stand, and in that at least one first web fixing device for fixing a first section of a printing substrate web relative to the first web fixing device and/or relative to the stand is provided along this first provided transport path. Fixing is understood, in particular, not merely as a bracing against gravitational force, but rather a relative immobility, in particular with respect to any movement in any direction. Preferably, the printing assembly is alternatively or additionally characterized by the fact that along this first provided transport path, and in particular downstream of the at least one first web fixing device, at least one second web fixing device, which is connected to the at least one support element that is movable relative to the stand and is likewise movable relative to the stand, at least together with said at least one support element that is movable relative to the stand, is provided for fixing a second section of a web of printing substrate relative to the second web fixing device and/or relative to the at least one movable support element. The at least one first web fixing device is preferably arranged at least partially immovably relative to the stand of the at least one first printing assembly and/or at least partially on the stand of the at least one first printing assembly. The at least one second web fixing device is preferably arranged at least partially immovably relative to the at least one support frame and/or at least partially on the at least one support frame. A joint movement of two objects is preferably understood to mean, in particular, a movement in which the centers of gravity of these objects move relative to an additional object, for example relative to the stand, but in which the distance between these centers of gravity remains the same.

Preferably, the printing unit is alternatively or additionally characterized in that the at least two guide elements that together define the first transport path provided for printing substrate are arranged, preferably on said at least one support element, so as to move, in particular pivot, together with the at least one support element, relative to the stand. The at least two guide elements are preferably stationary guide elements relative to the at least one support element. Preferably, the printing assembly is alternatively or additionally characterized by the fact that the at least one support element is arranged so as to pivot, together with the at least one second web fixing device and/or together with the at least two guide elements, about the at least one common pivot axis, in particular by means of at least one common pivot drive and/or in one joint movement. The at least one second web fixing device is preferably arranged so as to be movable independently of the at least one first web fixing device. Preferably, the printing assembly is alternatively or additionally characterized by the fact that the second web fixing device is movable relative to the first web fixing device, in particular together with the at least two guide elements, and/or in that a distance between the at least one second web fixing device and the at least one first web fixing device can be adjusted. The entire second web fixing device is preferably movable relative to the entire first web fixing device. Preferably, the printing assembly is alternatively or additionally characterized by the fact that the at least one first web fixing device is disposed on the frame of the printing assembly. Preferably, the printing assembly is alternatively or additionally characterized by the fact that an optionally provided maximum adjustment path of the at least one first web fixing device is less than one-tenth of the maximum adjustment path of the at least one second web fixing device.

Preferably, the printing assembly is alternatively or additionally characterized by the fact that the at least one second web fixing device, in particular together with the part of the second section of the at least one printing substrate web that is fixed thereto, can be arranged at different distances from the at least one image producing device, which is preferably embodied as a print head.

Preferably, the printing assembly is alternatively or additionally characterized by the fact that along this first provided transport path, between the at least one first web fixing device and the at least one second web fixing device, at least one connecting region of at least one connecting aid is disposed, said at least one connecting aid more preferably being at least one connecting aid for connecting at least two ends of printing substrate webs. For example, the connecting aid is at least partially a part of the at least one first web fixing device and/or is at least partially a part of the at least one second web fixing device.

Preferably, the printing assembly is alternatively or additionally characterized by the fact that the printing assembly has at least two image producing devices, each of which defines application positions for printing fluid, and in that a printing section of the first transport path provided for printing substrate begins at a first application position in the printing assembly along said provided transport path and ends at a last application position in the printing assembly along said provided transport path, and in that the at least two guide elements that together define the provided transport path are arranged one in front of the other along the printing section of said first provided transport path.

Preferably, the printing assembly is alternatively or additionally characterized by the fact that at least one cutting device and/or at least one connecting device is disposed along the provided transport path between the at least one first web fixing device and the at least one second web fixing device. Preferably, the printing assembly is alternatively or additionally characterized by the fact that the first section of the printing substrate web and the second section of the printing substrate web are part of the same printing substrate web, at least prior to a possible severing.

Preferably, the printing assembly is alternatively or additionally characterized by the fact that the at least one first web fixing device and/or the at least one second web fixing device is or are embodied as a suction device. Preferably, the printing assembly is alternatively or additionally characterized by the fact that the at least one first web fixing device and/or the at least one second web fixing device is or are embodied as a clamping device.

Preferably, the printing assembly is alternatively or additionally characterized by the fact that the at least one first web fixing device and the at least one second web fixing device are arranged at least twice as far, more preferably at least five times as far and even more preferably at least ten times as far from a roll holding device and/or from a post-processing device as from the next closest application position to them in the printing assembly along the transport path provided for printing substrate.

Further preferred is a method for handling a printing substrate web in a printing assembly, in which a printing substrate web is preferably first placed in an stopped state, if applicable, and at least a part of the printing substrate web is fixed by means of a first web fixing device relative to said first web fixing device and/or relative to a stand of the printing assembly, and at least a part of the printing substrate web is fixed by means of a second web fixing device relative to said second web fixing device and/or relative to a movable support element of the printing assembly that supports said second web fixing device. Such fixations are carried out, for example, by activating at least one suction device. Preferably, such fixations are carried out by activating at least one clamping device. The method is preferably characterized by the fact that at least one part of a printing substrate web is fixed by means of a first web fixing device relative to said first web fixing device and/or relative to a stand of the printing assembly, in that said part of the printing substrate web is clamped from two sides by respective clamping elements, between which a magnetically attractive force is acting, and/or in that at least one part of the printing substrate web is fixed by means of a second web fixing device relative to said second web fixing device and/or relative to a movable support element of the printing assembly that supports said second web fixing device, in that said part of the printing substrate web is clamped from two sides by respective clamping elements, between which a magnetically attractive force is acting.

The printing substrate web is preferably separated into a first section and a second section at a cutting point located along the printing substrate web between the first web fixing device and the second web fixing device, so that at least one part of the first section of the at least one printing substrate web is fixed relative to the first web fixing device and/or relative to the stand, and so that at least one part of the second section of the at least one printing substrate web is fixed relative to the second web fixing device and/or relative to the support element that supports the second web fixing device and/or preferably relative to the at least two guide elements that are movable together with the at least one support element. The at least one second web fixing device is then preferably moved together with the second section of the printing substrate web fixed thereto, and is moved away from the first web fixing device and from the first section of the printing substrate web fixed thereto.

Preferably, the method is alternatively or additionally characterized by the fact that the at least one second web fixing device is moved together with the second section of the printing substrate web fixed thereto, and is removed from the first web fixing device and the first section of the printing substrate web fixed thereto, in that the support element that supports the second web fixing device is pivoted together with the second web fixing device about at least one common pivot axis.

Preferably, the method is alternatively or additionally characterized by the fact that the movement of the second section of the printing substrate web away from the first section of the printing substrate web opens up a maintenance space in which maintenance work is preferably carried out. During said maintenance work, for example, at least one operator and/or at least one maintenance device is at least temporarily positioned in such a way that a rectilinear connection between the first web fixing device and the second web fixing device intersects said operator and/or said maintenance device. Maintenance work involves, for example, at least the cleaning of at least one shielding device. Preferably, the method is alternatively or additionally characterized by the fact that during the movement of the second section of the printing substrate web away from the first section of the printing substrate web, at least one guide element that defines the transport path is moved, in particular pivoted, into a maintenance position, and in that as a result, at least one shielding device and/or at least one nozzle of a print head of the printing assembly is further preferably accessible.

Preferably, the method is alternatively or additionally characterized by the fact that at least one platform is then moved along a staging path from a standby position into a position of use, in which a first distance between the platform and the first web fixing device and a second distance between the platform and the second web fixing device are each shorter than a third distance between the first web fixing device and the second web fixing device. Preferably, the method is alternatively or additionally characterized by the fact that afterward, for example once the maintenance task has been completed, the at least one platform is returned to its standby position.

Preferably, the method is alternatively or additionally characterized by the fact that the at least one second web fixing device is then moved together with the second section of the printing substrate web fixed thereto and is moved, in particular is pivoted, up to the first web fixing device and the first section of the printing substrate web fixed thereto, in particular until the ends of the two sections of the printing substrate web that were previously separated once again lie opposite one another. Preferably, the method is alternatively or additionally characterized by the fact that the previously separated ends of the two sections of the printing substrate web are then connected to one another, for example by a splicing process.

Preferably, the method is alternatively or additionally characterized by the fact that the first fixing device and the second fixing device are then deactivated in order to release the printing substrate web from them, for example by reducing the vacuum pressure of at least one suction device.

Preferred is a procedure for operating a printing assembly, wherein the printing assembly has at least two print heads that are each used for determining application positions for printing fluid, and wherein at least two guide elements of the printing assembly together define a transport path provided for printing substrate through the printing assembly, and wherein a printing section of the transport path provided for printing substrate begins at a first application position in the printing assembly along said provided transport path and ends at a last application position in the printing assembly along said provided transport path, and wherein said at least two guide elements that together define said provided transport path in the region of the printing section are pivoted by a pivot angle of at least 10° about at least one pivot axis common to them, from a working position into a maintenance position.

The method is preferably characterized, for example, in that a part of a printing substrate arranged at least partially in the printing assembly is pivoted, together with the at least two guide elements that together define said provided transport path in the region of the printing section, about the at least one common pivot axis.

Preferably, the method is alternatively or additionally characterized by the fact that the part of the printing substrate which is arranged at least partially in the printing assembly is pivoted together with the at least two guide elements that together define said provided transport path in the region of the printing section by a pivot angle of at least 10°, more preferably at least 20° and even more preferably at least 30° about the at least one common pivot axis.

Preferably, the method is alternatively or additionally characterized by the fact that a main conveying direction is defined by a rectilinear connection between a guide element that is first with respect to the printing section of the transport path provided for printing substrate, and that contributes to defining said transport path in the region of the printing section, and a guide element that is last with respect to the printing section of the transport path provided for printing substrate, and that contributes to defining said transport path in the region of the printing section, and in that when the guide elements that contribute to defining said transport path in the region of the printing section are arranged in their maintenance position, the main conveying direction is disposed at an angle of at most 30°, more preferably at most 20° and even more preferably at most 10° in relation to a vertical direction.

Preferably, the printing machine having the at least one first printing assembly is characterized by the fact that along the transport path provided for printing substrate, downstream of the at least one first printing assembly, at least one first dryer is provided, which comprises a region of the transport path provided for printing substrate that is configured as a drying section and is defined by an area of action of the at least one first dryer, and by the fact that over at least one-half, and more preferably over at least 75% of the drying section as a whole, a transport direction provided for the printing substrate has at least a vertical, preferably a downward pointing component which is greater than any horizontal component of this transport direction that may be present. This results in a particularly safe construction, because even in the event of a shutdown and/or a tearing of the printing substrate web, printing substrate is not allowed to lie directly above and/or on hot components of the dryer where it could become damaged or even catch fire.

The invention can preferably be used with various non-impact printing methods, in particular for ionographic methods, magnetographic methods, thermographic methods, eletrophotography, laser printing and in particular inkjet printing methods. In the foregoing and in the following, embodiments and variants that are described for "printing inks"—except where an obvious contradiction is clear—can be applied to any type of flowable printing fluids, including in particular colored or colorless varnishes and relief-producing materials such as, for example, pastes, and can be transferred by a—suggested or actual—replacement of the expression "printing ink" with the broader term "printing fluid" or with a specialized expression "varnish", "high-viscosity printing ink", "low-viscosity printing ink" or "ink", or "paste" or "pasty material".

BRIEF DESCRIPTION OF THE DRAWINGS

Exemplary embodiments of the invention are illustrated in the set of drawings and will be described in greater detail in the following.

The drawings show.

DESCRIPTION OF THE PREFERRED EMBODIMENTS

Figure 1:
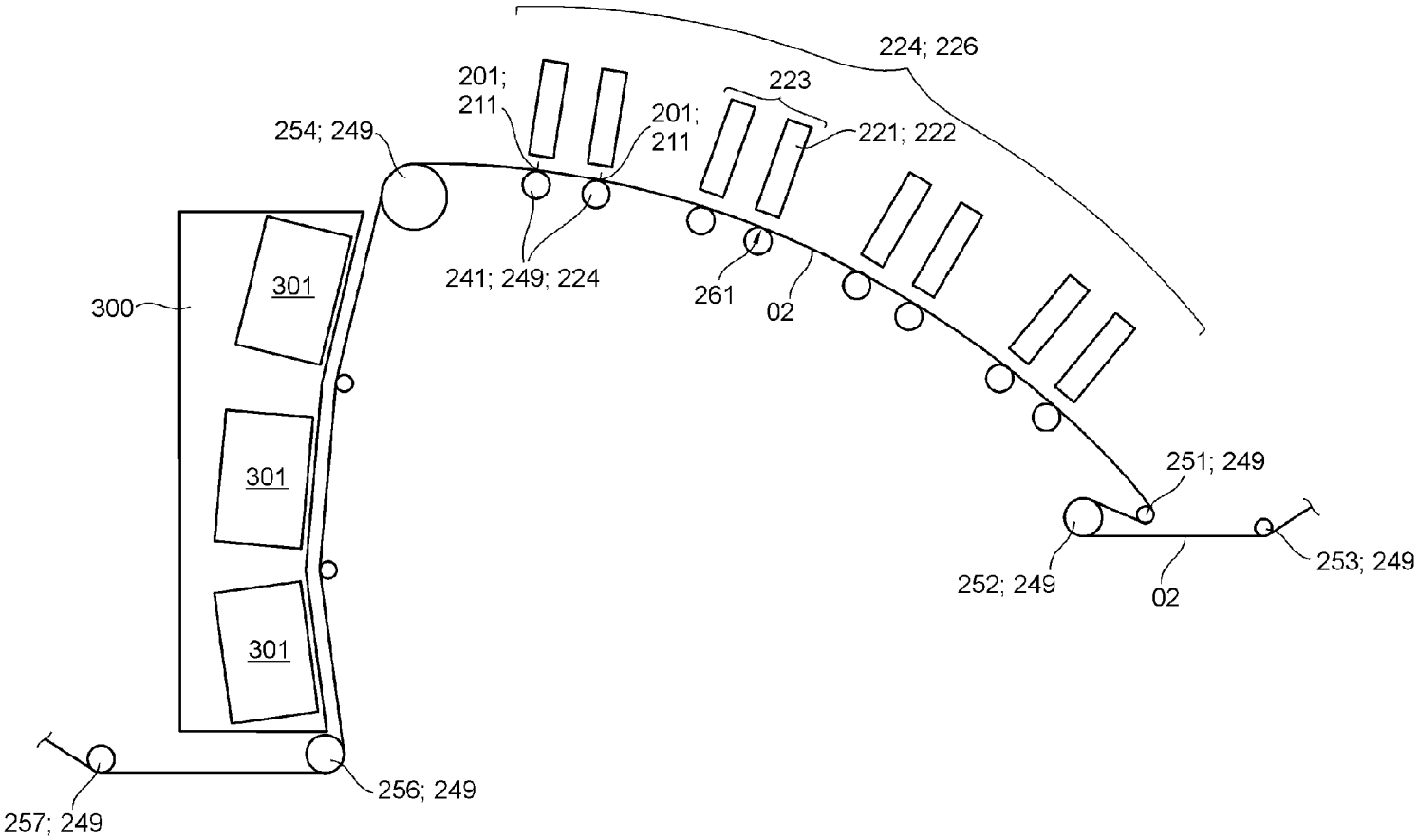
FIG. 1 a schematic diagram of a transport path for printing substrate through a printing assembly and a dryer.

In the foregoing and in the following, the term printing fluid includes inks and printing inks, but also varnishes and pasty materials. Printing fluids are preferably materials that are and/or can be transferred by means of a printing machine 01 or at least one printing assembly 200 of the printing machine 01 onto a printing substrate 02, and which thereby create on the printing substrate 02 a texture, preferably in finely structured form and/or not merely over a large area, which texture is preferably visible and/or perceptible by the senses and/or detectable by machine. Inks and printing inks are preferably solutions or dispersions of at least one colorant in at least one solvent. Suitable solvents include water and/or organic solvents, for example. Alternatively or additionally, the printing fluid can be embodied as printing fluid that is cured under UV light. Inks are relatively low-viscosity printing fluids and printing inks are relatively high-viscosity printing fluids. Inks preferably contain no binding agent or relatively little binding agent, whereas printing inks preferably contain a relatively large amount of binding agent, and further preferably contain additional auxiliary agents. Colorants may be pigments and/or dyes, with pigments being insoluble in the application medium, whereas dyes are soluble in the application medium.

In the interest of simplicity, in the foregoing and in the following—unless explicitly distinguished and specified accordingly—the term "printing ink" or "printing fluid" is understood as a liquid or at least flowable coloring fluid to be used for printing in the printing machine, and is not restricted to the higher viscosity coloring fluids more frequently associated colloquially with the expression "printing ink" for use in rotary printing machines, but in addition to these higher viscosity coloring fluids particularly also includes lower viscosity coloring fluids such as "inks", in particular inkjet inks, but also powdered coloring fluids, such as toners, for example. Thus in the foregoing and in the following, when printing fluids and/or inks and/or printing inks are mentioned, this also includes colorless varnishes. In the foregoing and in the following, when printing fluids and/or inks and/or printing inks are mentioned, this also preferably includes, in particular, means for pretreating (precoating) the printing substrate 02. The term coating agent may be understood as synonymous with the term printing fluid.

A printing machine 01 should be understood here as a machine that is capable of applying at least one printing fluid to a printing substrate 02. A printing machine 01 preferably has at least one printing substrate source, preferably at least one first printing assembly 200, preferably at least one first means that assists with drying, i.e. first auxiliary drying means 301, for example a first dryer 301, and preferably at least one post-processing device. Where appropriate, printing machine 01 has, for example, at least one second printing assembly and, for example, at least one second means that assists with drying, i.e. auxiliary drying means, for example a second dryer. Printing machine 01 is preferably embodied as an inkjet printing machine 01. Preferably, printing machine 01 is embodied as a web-fed printing machine 01, more preferably as a web-fed inkjet printing machine 01. Printing machine 01 can be embodied as a printing machine 01 that operates based on the inkjet method—as a whole or optionally in addition to other non-impact printing methods and/or printing forme-based methods—in particular as an inkjet printing machine 01. The at least one first printing assembly 200 is preferably embodied as at least one first inkjet printing assembly 200. In particular, printing assembly 200 is preferably a printing assembly 200 for processing web-type printing substrate 02.

In the case of a web-fed printing machine 01, the printing substrate source is embodied as a roll unwinding device. In the printing substrate source, at least one printing substrate 02 is preferably aligned, preferably with respect to at least one edge of said printing substrate 02. In the roll unwinding device of a web-fed printing machine 01, at least one web-type printing substrate 02, that is, a printing substrate web 02, preferably a paper web 02, is unwound from a printing substrate roll 101 and is preferably aligned with respect to its edges in an axial direction A. Axial direction A is preferably a direction A that extends in a transverse direction A, parallel to a rotational axis of a roll of printing substrate. Transverse direction A is preferably a horizontally extending direction A. Transverse direction A is oriented orthogonally to the provided transport direction of printing substrate 02 and/or orthogonally to the provided transport path of printing substrate 02 through the at least one first printing assembly 200. Downstream of the at least one printing substrate source, a transport path of the at least one printing substrate 02 and, in particular, the printing substrate web 02 preferably extends through the at least one first printing assembly 200, where the printing substrate 02 and in particular the printing substrate web 02 is preferably provided on one side with a printed image by means of at least one printing ink.

In the case of a curved transport path, the transport direction is preferably the direction that in each case extends tangentially to a section and/or point on the provided transport path that is closest to a respective reference point. This respective reference point is preferably located at the point and/or on the component that is placed in relation to the transport direction.

In the following, the invention will be described in the context of an inkjet printing machine 01. However, the invention may also be used for other non-impact printing methods or for completely different printing methods, such as, for example, rotary printing, offset printing, lithography, letterpress printing, screen printing or gravure printing, as long as no contradictory circumstances exist. In the following, the invention will be described in conjunction with a web-type printing substrate 02, that is, a printing substrate web 02. However, corresponding features can preferably likewise be applied to printing machines 01 for use with sheet-type printing substrate 02, as long as no contradictory circumstances exist.

In the roll unwinding device, at least one printing substrate roll is rotatably arranged. In a preferred embodiment, the roll unwinding device is configured as suitable for accommodating one roll of printing substrate, and thus has only one storage position for a roll of printing substrate. In another embodiment, the roll unwinding device is embodied as a roll changer and has storage positions for at least two rolls of printing substrate. The roll changer is preferably configured to enable a flying roll change, that is to say a connection of a first printing substrate web 02 of a roll of printing substrate roll that is currently being processed to a second printing substrate web 02 of a roll of printing substrate to be subsequently processed while both the printing substrate roll currently being processed and the printing substrate roll to be subsequently processed are rotating.

The roll unwinding device preferably has a dancer roller, preferably arranged so as to be deflected on a dancer lever, and/or a first web edge aligner and/or an infeed mechanism, which has an infeed nip formed by a traction roller and a traction impression roller, and a first measuring device embodied as a first measuring roller, in particular as an infeed measuring roller, along the provided transport path of the printing substrate web 02 downstream of a roll holding device. Said traction roller preferably has its own drive motor, embodied as a traction drive motor, and is preferably connected to a machine controller. By means of the dancer roller, a web tension can be adjusted and maintained within limits, and/or preferably, the web tension is maintained within limits. The roll unwinding device optionally has a splicing and cutting device, by means of which a roll change can be carried out on a flying basis, that is, without stopping the printing substrate web 02. The infeed mechanism is preferably located downstream of the first web edge aligner. The at least one traction roller is preferably provided as a component of the infeed mechanism, and together with the traction impression roller, preferably forms the infeed nip. The infeed nip serves to regulate the web tension and/or to transport the printing substrate 02.

A printing assembly 200 is understood as a device by means of which a web-type or sheet-type printing substrate 02 is or can be provided with at least one printing fluid on at least one of its sides. The at least one first printing assembly 200 of the printing machine 01 preferably has at least one printing position 201. A printing position 201 is understood here as preferably an entire region in which contact is or can be established between the same printing fluid and a printing substrate 02. The term printing position 201 should also be used in cases in which the printing fluid is applied to the printing substrate 02 without pressure between printing substrate 02 on one side and a component that transfers the printing fluid on the other side, for example by freely movable printing fluid, for example flying droplets of the printing fluid, striking the printing substrate 02. Preferably, a printing position 201 comprises all the regions that are intended for an impingement of a specific printing fluid, assigned in particular to said printing position 201, on the printing substrate 02. In the case of a printing assembly 200 that operates according to the inkjet printing method, for example, a printing position 201 comprises all the regions that are intended for impingement of a black ink on a first side of the printing substrate 02.

The at least one first printing assembly 200 preferably has a plurality of printing positions 201, each of which is assigned a respective printing fluid, for example at least four printing positions 201, preferably at least five printing positions 201, more preferably at least six printing positions 201, and even more preferably at least seven printing positions 201.

A working width of the printing machine 01 and/or of the at least one printing assembly 200 is a dimension that preferably extends orthogonally to the provided transport path of the printing substrate 02 through the at least one first printing assembly 200, more preferably in the transverse direction A. Transverse direction A is preferably a horizontally extending direction A. Transverse direction A is oriented orthogonally to the provided transport direction of printing substrate 02 and/or orthogonally to the provided transport path of printing substrate 02 through the at least one printing assembly 200. The working width of printing machine 01 preferably corresponds to the maximum width a printing substrate 02 may have in order to still be processed by printing machine 01, that is to say a maximum printing substrate width that can be processed by the printing machine 01. The working width of printing machine 01 preferably corresponds to the working width of the at least one first printing assembly 200.

Each printing position 201 preferably has at least one application position 211. Each application position 211 is preferably assigned to at least one image producing device 221, in particular at least one print head 221 and more preferably at least one print head row 222. Each application position 211 preferably extends in the transverse direction A, more preferably over the entire working width of printing machine 01. In the case of an inkjet printing machine 01, the at least one image producing device 221 is preferably embodied as at least one print head 221, in particular an inkjet print head 221. The at least one printing assembly 200 preferably has at least two print heads 221. The at least one printing assembly 200 is characterized, for example, in that the at least two print heads 221 are embodied as print heads 221 that are configured for a non-impact printing method, and more preferably in that the at least two print heads 221 are embodied as inkjet print heads 221. image producing devices 221 such as print heads 221, for example, typically have limited dimensions, in particular in the transverse direction A. This results in a limited region of the printing substrate 02 onto which printing fluid can be applied by a respective print head 221. For that reason, a plurality of image producing devices 221 or print heads 221 are typically arranged one in front of the other in the transverse direction A. Such print heads 221 arranged one in front of the other in transverse direction A are referred to as a print head row 222. In the following, interrupted print head rows 222 and continuous print head rows 222 will be described. In the exceptional case in which a print head 221 extends over the entire working width, said print head should likewise be regarded as a print head row 222, in particular as a continuous print head row 222.

Typically, such individual print heads 221 are not equipped with nozzles all the way up to the edge of their housing. For that reason, preferably at least two and more preferably precisely two print head rows 222 extending in the transverse direction A are arranged offset relative to one another along the transport path provided for the printing substrate 02. Such print head rows 221 are discontinuous print head rows 222, for example. In each case, two such discontinuous print head rows 222, in particular, together form a double row 223 of print heads 221. The correspondingly offset arrangement of the print heads 221 of the two discontinuous print head rows 222 preferably allows the entire working width of printing machine 01 and/or of the at least one first printing assembly 200 to be reached by nozzles of the print heads. Preferably, a plurality of print head rows 222, more preferably at least four double rows 223 and even more preferably at least eight double rows 223 of print heads 221 are arranged one after the other, in particular aligned on the transport path provided for transport of the printing substrate 02, in a direction orthogonal to transverse direction A, in particular in the transport direction along the provided transport path of printing substrate 02. A printing fluid, in particular an ink of a specific color, preferably is and/or can be assigned to each double row 223 of print heads 221, for example one of the colors black, cyan, yellow and magenta each, or a varnish, for example a clear varnish, or a medium or substance mixture for a pretreatment (precoating) of printing substrate 02, or a special ink. With an appropriate configuration of the print heads 221, it is alternatively also conceivable for a continuous print head row 222 to be provided, the nozzles of which together cover the entire working width of printing machine 01.

Each nozzle is preferably assigned a clearly defined target region with respect to the direction A of the width of printing substrate web 02 and preferably with respect to the transverse direction A. Each target region of a nozzle is preferably clearly defined, at least during the printing operation. A target region of a nozzle is particularly the spatial, in particular substantially rectilinear area that extends outward from said nozzle in an ejecting direction of said nozzle. An impingement area is preferably an area that is provided for the contact of printing fluid with the printing substrate 02, in particular for the contact of droplets of printing fluid with the printing substrate 02. Each nozzle of each print head 221 is preferably assigned an impingement area, in particular in a direct inkjet printing process. An impingement area of a print head 221 is preferably the sum of all the impingement areas of nozzles of said print head 221. An application position 211 is preferably the sum of all the impingement areas of, in particular, functionally combined print heads 221, which together span the entire working width of printing machine 01. In the case of pairs of discontinuous print head rows 222 configured as double rows 223, an application position 211 is preferably the sum of the impingement areas of the print heads 221 that together form the double row. In the case of continuous print head rows 222, an application position 211 is preferably the sum of the impingement areas of the print heads 221 that together form the continuous print head row 222.

For example, a plurality of application positions 211 are assigned to at least one printing fluid, for example, in such a way that two double rows 223 of print heads 221 eject or are capable of ejecting the same printing medium. This is useful, for example, for increasing the resolution of a printed image and/or for increasing the speed of a printing process. These multiple application positions 211 then together form the printing position 201 assigned to said printing medium.

For example, a first printing position 201 and/or a first application position 211 along the provided transport path is used for the application of a medium or a mixture of substances for pretreatment (precoating) of the printing substrate 02. This allows said medium or mixture of substances to be applied selectively and purposefully to the printing substrate 02, in particular only at those points where a further treatment of the printing substrate 02 that necessitates such a pretreatment will take place, for example the application of an additional printing fluid.

A printing assembly 200 may comprise, for example, only one printing position 201, for example for the color black. Preferably, however, the at least one first printing assembly 200 has a plurality of printing positions 201, as described. The printing positions 201 can be directly adjacent to one another in space or can be spaced from one another, for example, separated according to color. The concept of a printing position 201 also covers a section which—for example, without interruption by a different color—has a plurality of successive application positions 211 of the same color. However, if single or multiple application positions 211 for one color are separated by at least one single or by multiple application positions 211 for at least one other color, as viewed along the transport path provided for printing substrate 02, these are considered to be two printing positions 201 that are different from one another, as described herein. In the case of only one printing position 201, said position acts as both the first and the last printing position 201 of the printing assembly 200 in question. For example, in the case of an indirect inkjet printing method, a printing position is an area of contact between a transfer body and the printing substrate 02.

The at least one printing assembly 200 preferably has at least one print head 221, which is further preferably embodied as at least one inkjet print head 221. Each print head 221 preferably has a plurality of nozzles from which droplets of printing fluid, in particular ink droplets, are and/or can be ejected. Preferably, the at least one printing assembly 200 has at least one nozzle bar 231. A nozzle bar 231 in this case is a component that preferably extends over at least 80% and more preferably at least 100% of the working width of the printing machine 01 and/or preferably serves as the support for the at least one print head 221. In this case, for example, a single or preferably a plurality of nozzle bars 231 are provided for each printing assembly 200. More preferably, the at least one printing assembly 200 has at least three nozzle bars 231, even more preferably at least five nozzle bars 231, and more preferably still at least fourteen (14) nozzle bars 231.

The at least one first nozzle bar 231 preferably extends orthogonally to the provided transport path of the printing substrate 02 over the entire working width of printing machine 01, in particular in transverse direction A. The at least one nozzle bar 231 preferably has at least one row of nozzles, in particular because at least one print head 221 that has nozzles is arranged on the at least one nozzle bar 231. The at least one row of nozzles, as viewed in the transverse direction A, preferably has nozzle openings at regular intervals over the entire working width of printing machine 01. In one embodiment, a single continuous print head 221 is provided for this purpose, which extends in transverse direction A over the entire working width of printing machine 01. In another preferred embodiment, a plurality of print heads 221 are arranged on the at least one nozzle bar 231 side by side in transverse direction A.

The at least one nozzle bar 231 preferably has at least one print head 221, and preferably each has a plurality of print heads 221. In the case in which the at least one nozzle bar 231 has only one print head 221 each, said print head 221 preferably extends over the entire working width of printing machine 01. In the case in which the at least one nozzle bar 231 has a plurality of print heads 221 each, these print heads 221 are preferably configured as at least one print head row 221 or more preferably as at least one double row 223 of print heads 221, and the at least one print head row 222 or double row 223 of print heads 221 preferably extends over the entire working width of the printing machine 01. In the case of a double row 223 of print heads 221, the at least one row of nozzles of the respective nozzle bar 231 is preferably divided into at least two discontinuous print head rows 222.

If a print head 221 has a plurality of nozzles, all the target regions of the nozzles of said print head 221 together form a working region of said print head 221. Working regions of print heads 221 of a nozzle bar 231 and in particular of a double row of print heads 221 border one another and/or overlap one another in transverse direction A, as viewed in transverse direction A. In this way, even if print head 221 is discontinuous in transverse direction A, it is ensured that target regions of nozzles of the at least one nozzle bar 231 and/or in particular of each double row 223 of print heads 221 lie at regular and preferably periodic intervals, as viewed in transverse direction A. In any case, an entire working region of the at least one nozzle bar 231 preferably extends over at least 90% and more preferably at least 100% of the working width of printing machine 01 in the transverse direction A or the entire width of a printing substrate guiding unit 249. On one or both sides with respect to axial direction A, a narrow region of printing substrate web 02 and/or of the width of printing substrate guiding unit 249 may be present, which is not a part of the working region of nozzle bar 231. An entire working region of the at least one nozzle bar 231 is preferably composed of all the working regions of print heads 221 of said at least one nozzle bar 231 and is preferably composed of all the target regions of nozzles of said print heads 221 of said at least one nozzle bar 231. Preferably, an entire working region of a double row 223 of print heads 221, as viewed in transverse direction A, corresponds to the working region of the at least one nozzle bar 231. A printing fluid of a specific color, for example one of the colors black, cyan, yellow and magenta, or a varnish, for example a clear varnish, preferably is and/or can be assigned to each double row 223 of print heads 221. Preferably, all of the working regions of print heads 221 of the at least one first printing assembly 200 together form a working region of said at least one first printing assembly 200.

The at least one nozzle bar 213 preferably has a plurality of rows of nozzles in the conveying direction of a printing substrate guiding unit 249. Said conveying direction of the printing substrate guiding unit 249 is preferably identical to the transport direction of the transport path provided for the transport of printing substrate 02. Each print head 221 preferably has a plurality of nozzles, which are further preferably arranged in a matrix of multiple rows in transverse direction A and/or multiple columns, preferably in the direction of conveyance of printing substrate guiding unit 249, said columns being arranged extending obliquely to the conveying direction of printing substrate guiding unit 249, for example, to increase the resolution of a printed image, for example.

The at least one print head 221 works to generate droplets of printing ink, preferably using the drop-on-demand method, in which droplets of printing ink are generated selectively, as needed. Preferably, at least one heating element is used per nozzle, which generates an evaporation of printing fluid within a reservoir. The volume that is displaced by the resulting gas bubble causes a volume of printing fluid that corresponds substantially to the gas bubble to be ejected from the corresponding nozzle, in particular in the form of a droplet. The development of heat in the heating element and thus the size of the printing ink droplets are influenced by varying the flow of current through the heating element. This allows color gradations to be achieved in the resulting printed image, without altering the number of droplets used to produce the printed image (amplitude modulation). Alternatively, at least one piezoelectric element may be used per nozzle, which is capable of reducing a volume filled with printing ink by a certain percentage at high speed when a voltage is applied. This causes printing ink to be displaced and ejected through a nozzle which is connected to the volume that is filled with printing ink, forming at least one droplet of printing ink. By applying different voltages to the piezoelectric element, the adjustment path of the piezoelectric element and as a result, the reduction in the volume and thus the size of the printing ink droplets can be influenced.

In the drop-on-demand method, it is not necessary for a droplet to be deflected after its ejection from the corresponding nozzle, since the target position of each printing ink droplet on the moving printing substrate web 02 can be defined with respect to the direction of conveyance of the printing substrate guiding unit 249 based solely on the ejection time of the respective printing ink droplet and the speed of conveyance of printing substrate guiding unit 249. Actuating each nozzle individually allows printing ink droplets to be transferred from the at least one print head 221 onto printing substrate web 02 only at selected times and at selected locations. This is carried out based on the speed of conveyance and/or the position of the conveying means of printing substrate guiding unit 249, the distance between the respective nozzle and the printing substrate web 02 and the position of the target region of the respective nozzle in relation to the position of the printing substrate guiding unit 249 as viewed in the transport direction. This results in a desired printed image, which is formed based on the actuation of all nozzles. The ejection of ink droplets from the at least one nozzle of the at least one print head 221 is preferably carried out based on the angular position of the first drive motor, which is specified by the machine controller. The setpoint data for the angular position of the first drive motor, specified by the machine controller to the first drive motor, are preferably included in real time in a calculation of data for actuation of the nozzles of the at least one print head 221. A comparison with actual data for the angular position of the first drive motor is preferably not necessary and preferably is not carried out. The precise and constant positioning of printing substrate web 02 relative to the first printing substrate guiding unit 249 is therefore of great importance for precise color registration and/or a true-to-register printed image.

The high precision of the setpoint data for the angular position of the first drive motor of printing substrate guiding unit 249, specified by the machine controller and processed by the first drive motor, enables a highly precise determination and/or knowledge of the position of printing substrate web 02 relative to the nozzles and the target regions thereof. The droplet flight time between the nozzles and printing substrate web 02 is known, for example, based on a learning process and/or based on the known distance between the nozzles and printing substrate web 02 and a known droplet velocity. From the position of printing substrate guiding unit 249 and/or the first drive of the printing substrate guiding unit 249, the conveyance speed of printing substrate guiding unit 249 and the droplet flight time, an ideal time for ejection of a respective droplet is determined, so that a precise color registration and/or true-to-register printing of the image on printing substrate web 02 is achieved.

A conveying line, in particular a conveying line for printing substrate, preferably comprises those devices 241; 251; 252; 253; 254; 256; 257 that define a transport path for the printing substrate, for example rollers, cylinders, guide elements and the like. A conveying line in the at least one first printing assembly 200 that extends from a first printing position 201 along the transport path provided for printing substrate 02 in the at least one first printing assembly 200 up to a last printing position 201 along the transport path provided for printing substrate 02 in the at least one first printing assembly 200, is referred to as the printing line 224 of the at least one first printing assembly 200. The transport path provided here is the spatial area that printing substrate 02 would occupy if it were present. The conveying line of the at least one first printing assembly 200 preferably comprises those devices 241; 251; 252; 254; 256 that define the transport path through the at least one first printing assembly 200, in particular both the provided transport path, regardless of whether or not printing substrate 02 is present, and the actual transport path when printing substrate 02 is present. The portion of the provided transport path for printing substrate 02 that is defined by printing line 224, is referred to as printing section 226 of the provided transport path.

Figure 2:
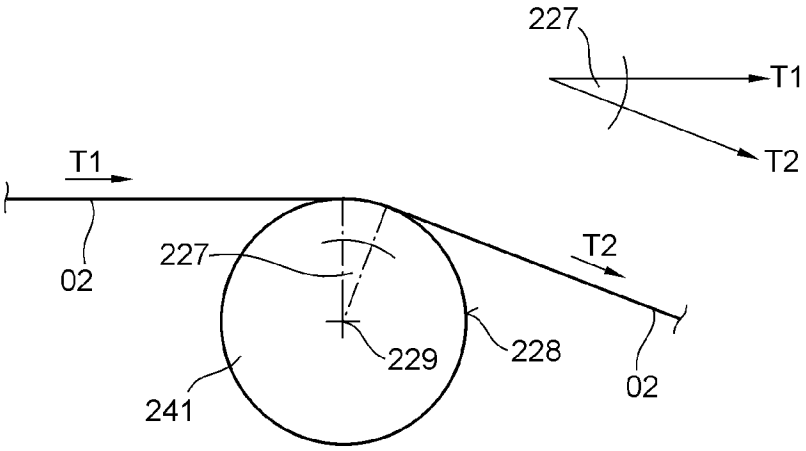
FIG. 2 a schematic diagram illustrating the turning of a printing substrate on a guide element.
Figure 3:
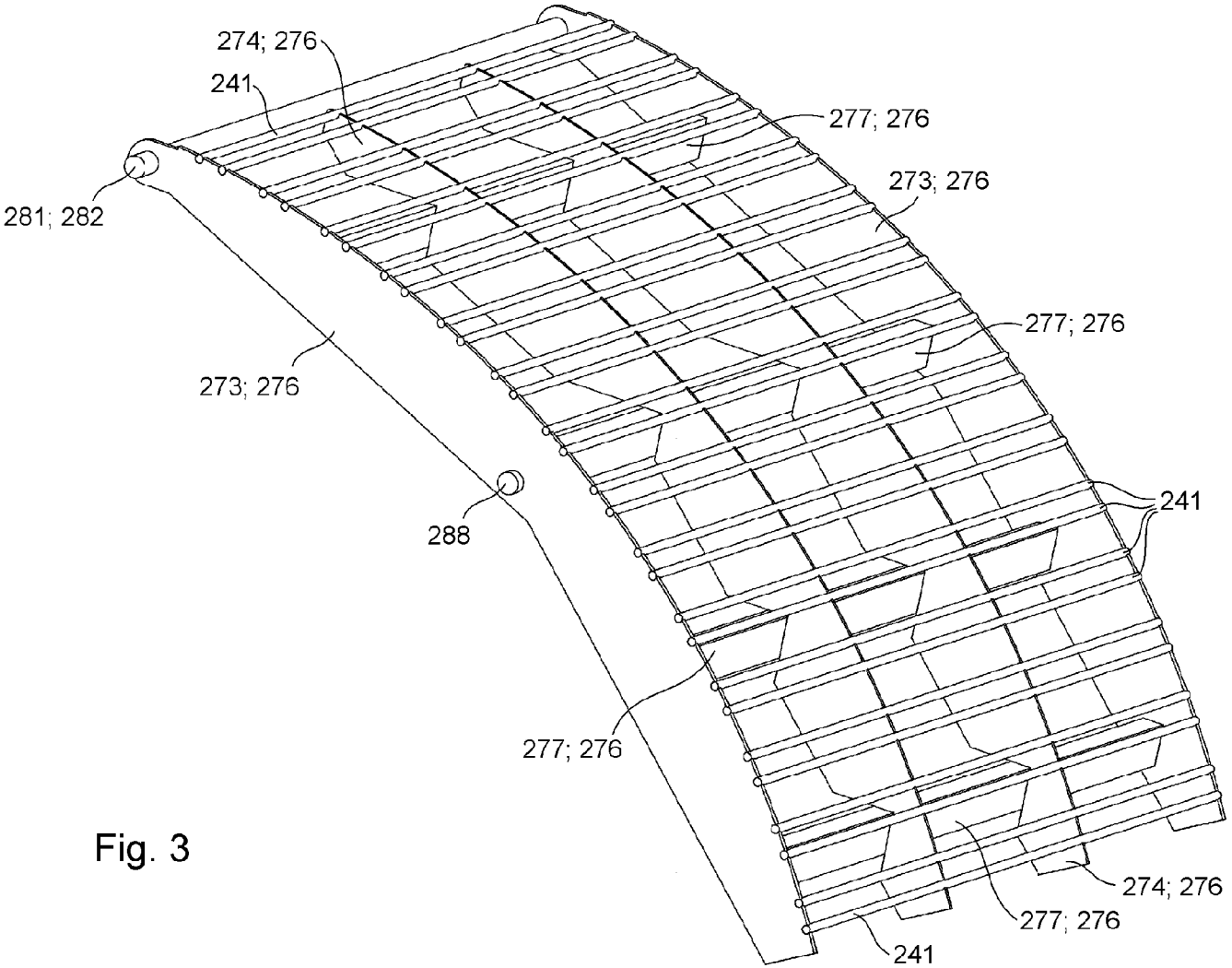
FIG. 3 a schematic diagram of a set of guide elements held by a common support frame.
Figure 4:
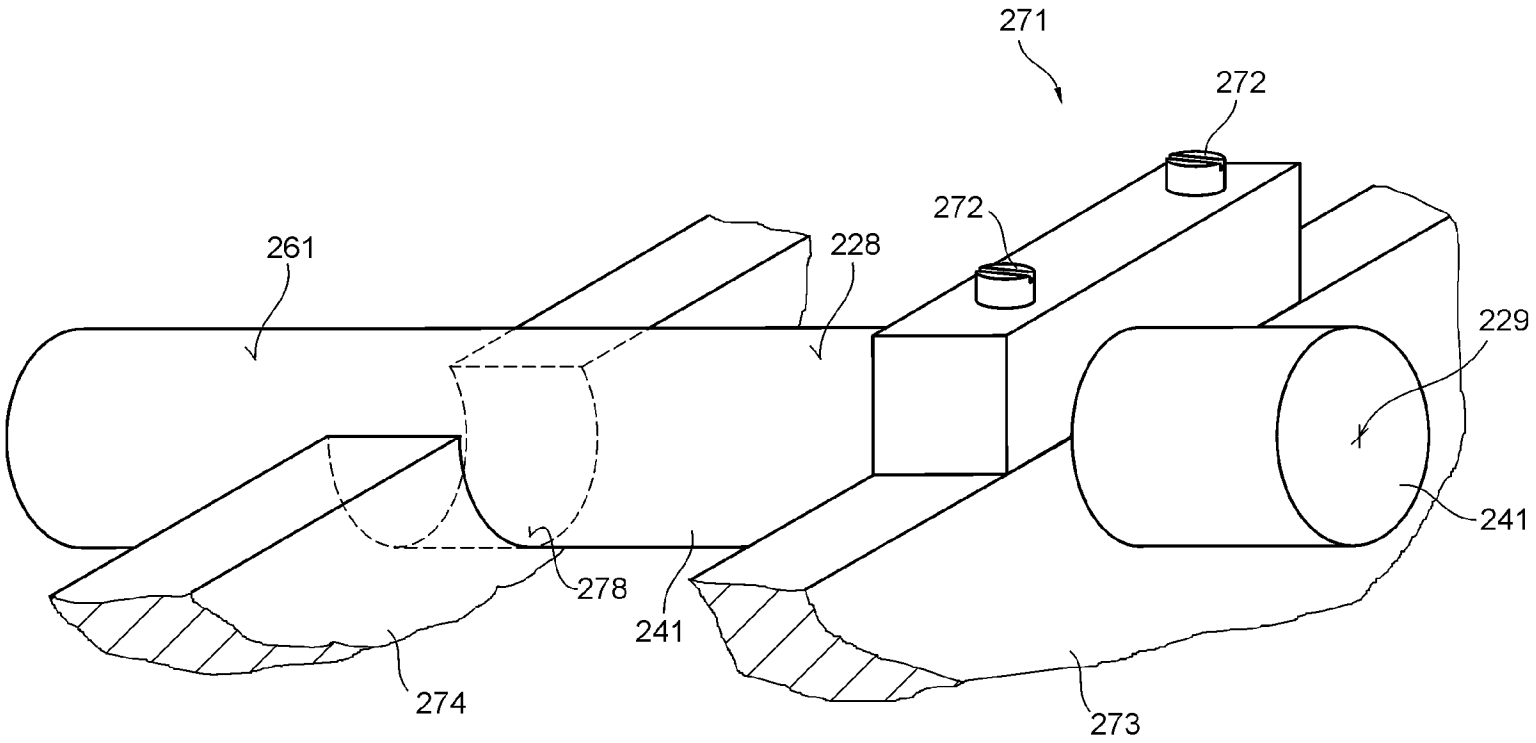
FIG. 4 a schematic diagram of a mounting device for a guide element.
Figure 5:
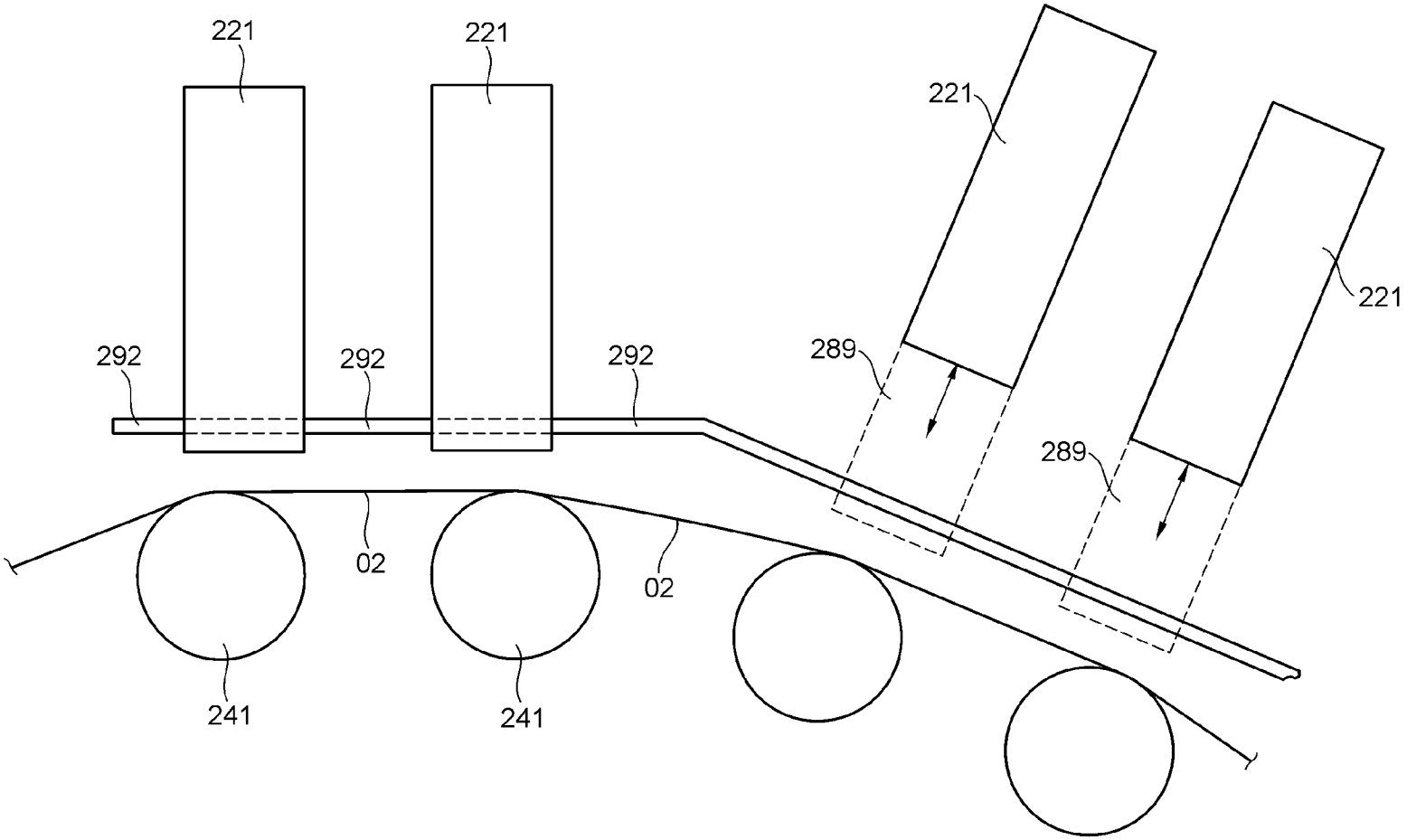
FIG. 5 a schematic diagram of part of a printing section.
Figure 6A:
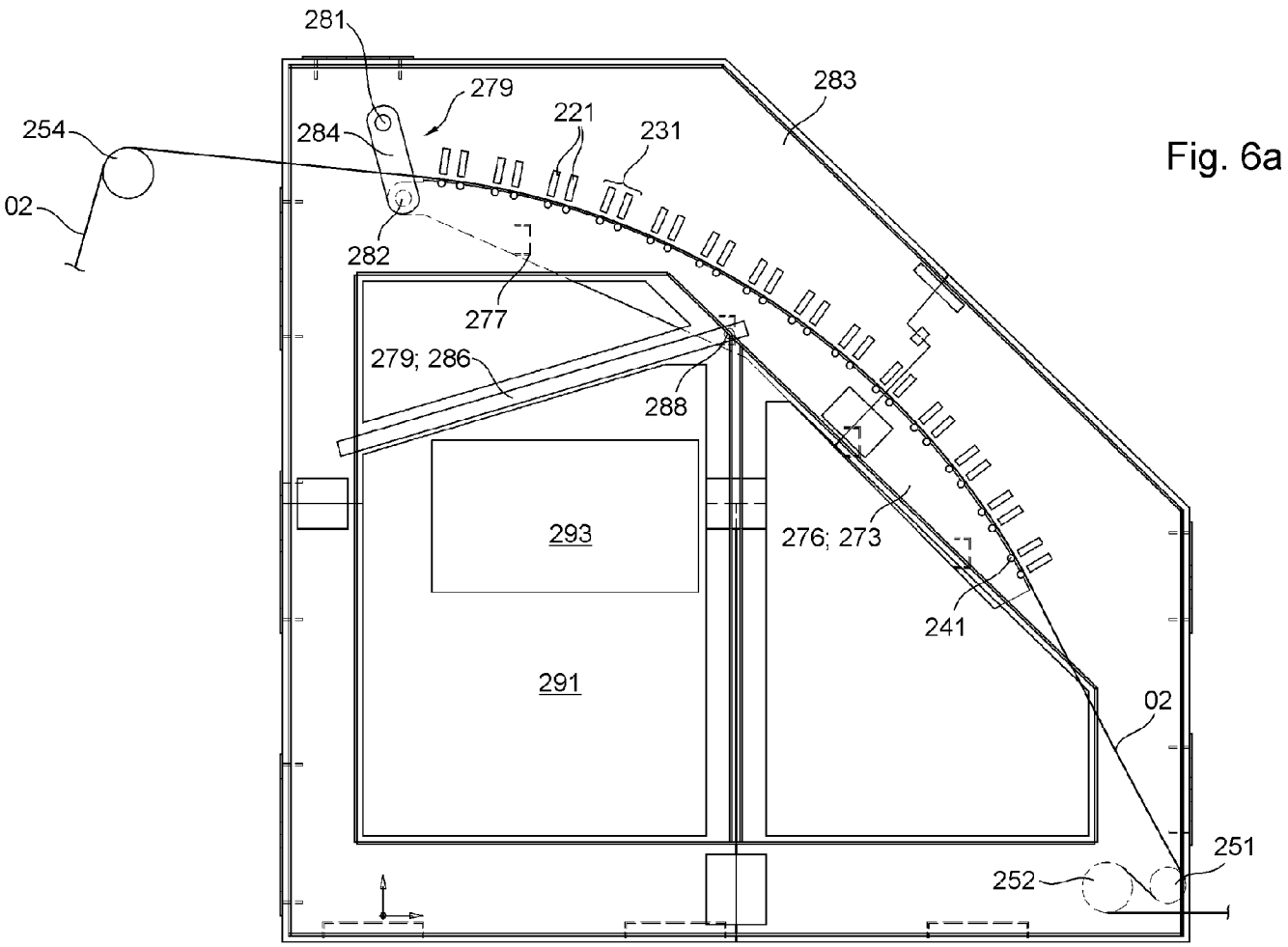
FIG. 6*a* a schematic diagram of a printing assembly having guide elements in a working position and print heads in a printing position.
Figure 6B:
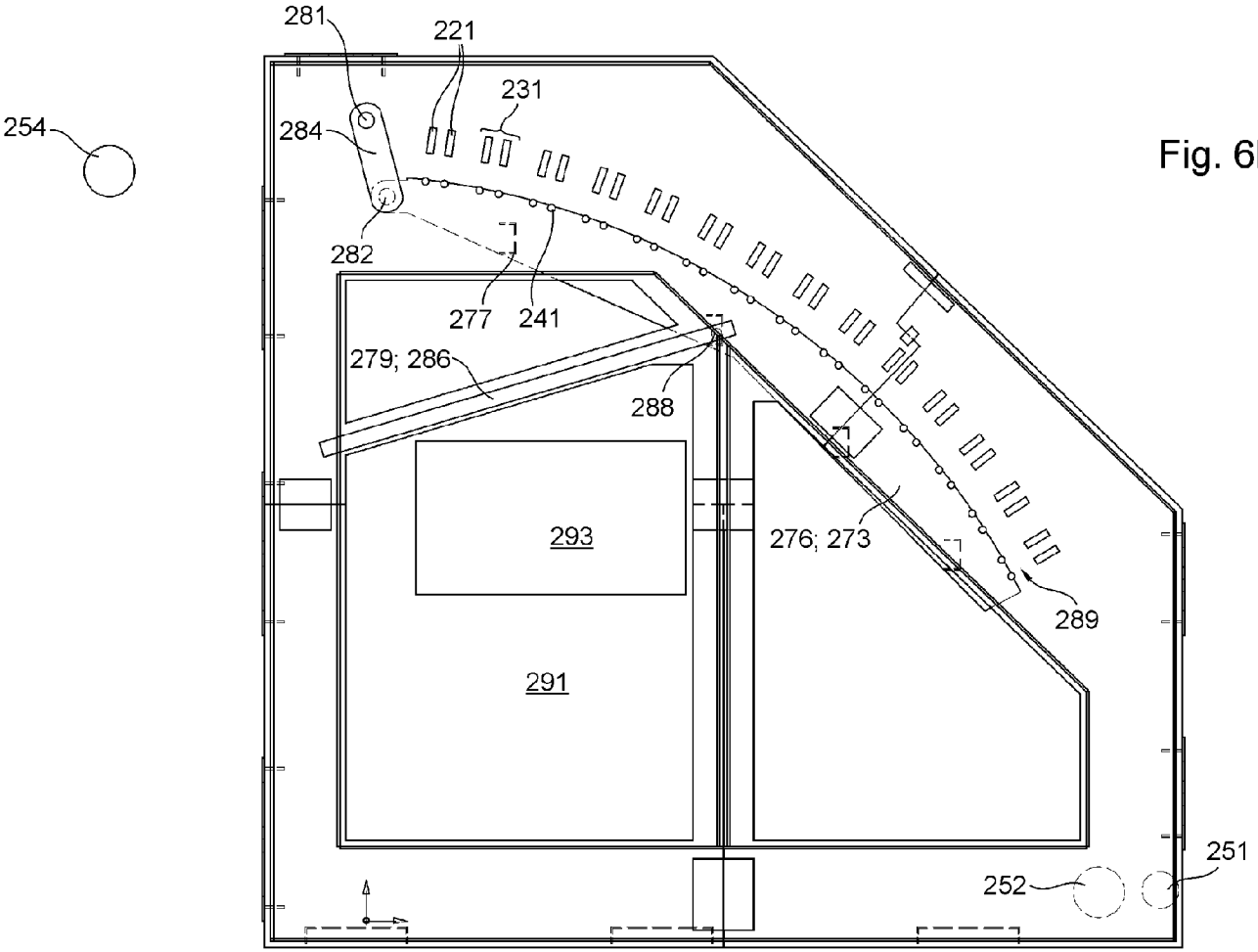
FIG. 6*b* a schematic diagram of the printing assembly according to FIG. 1*a* with guide elements in a working position and print heads in a thrown off position.
Figure 6C:
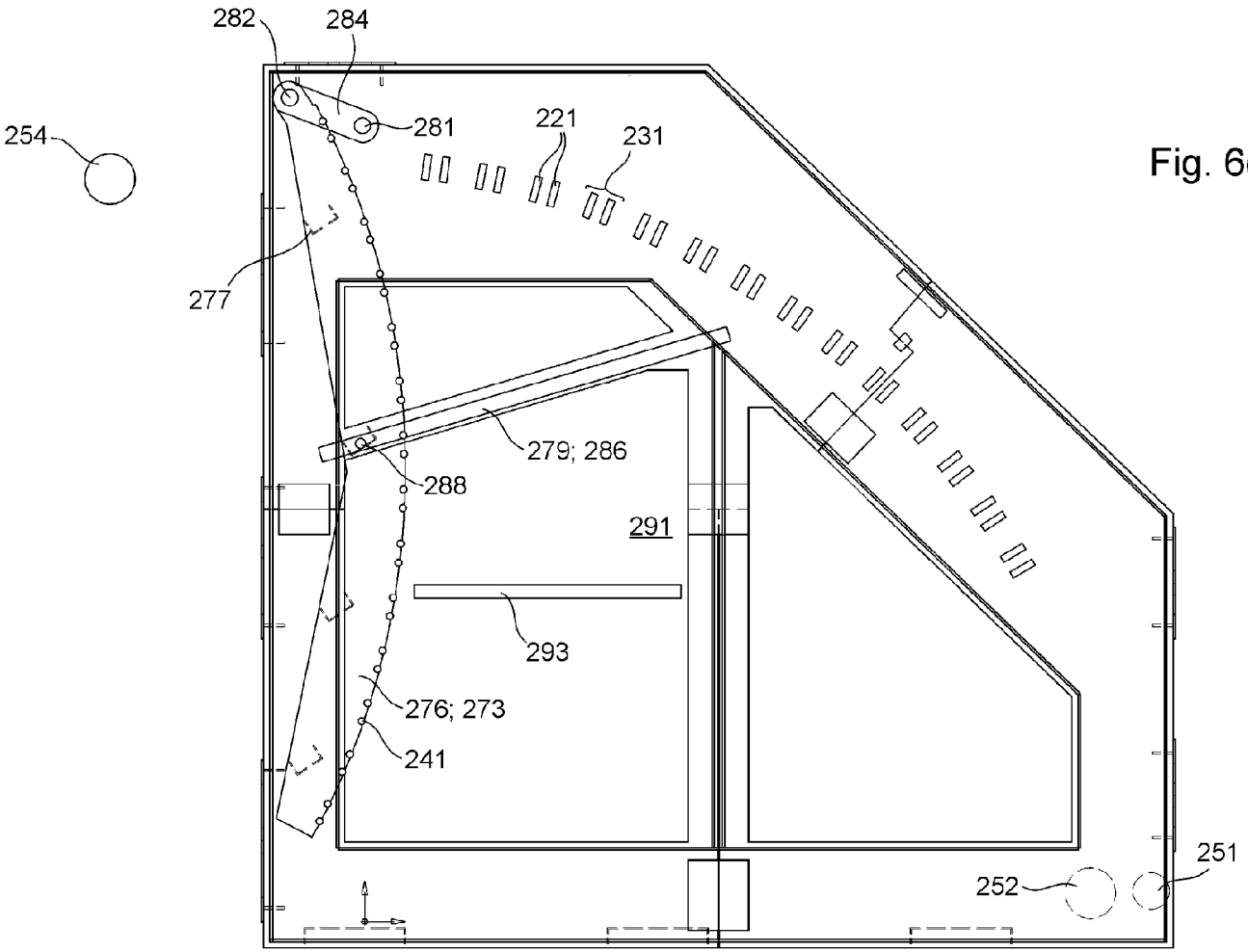
FIG. 6*c* a schematic diagram of the printing assembly according to FIG. 1*a* with guide elements in a maintenance position and print heads in a printing position.
Figure 7A:
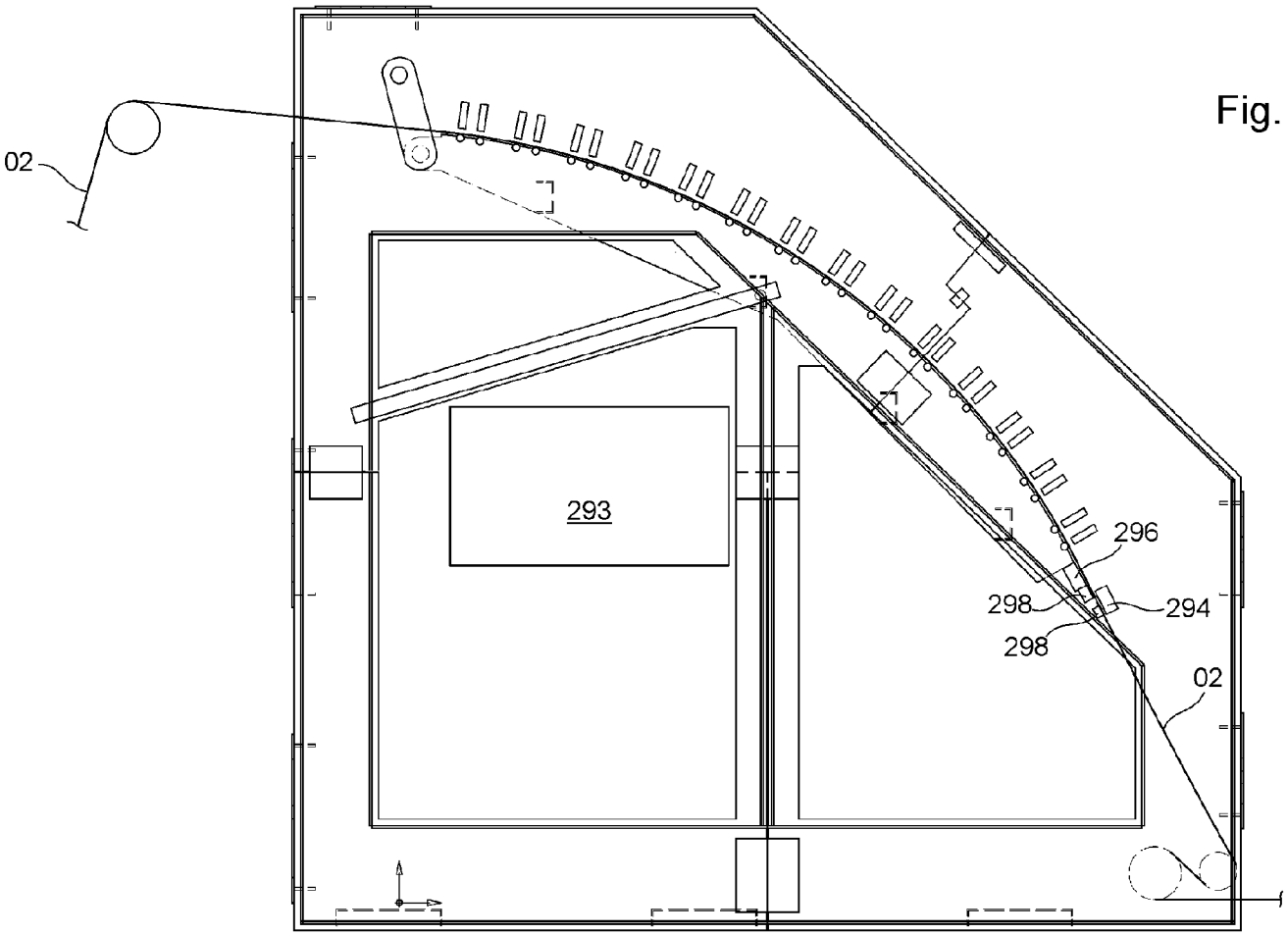
FIG. 7*a* a schematic diagram of a printing assembly with web fixing devices and with guide elements in a working position.
Figure 7B:
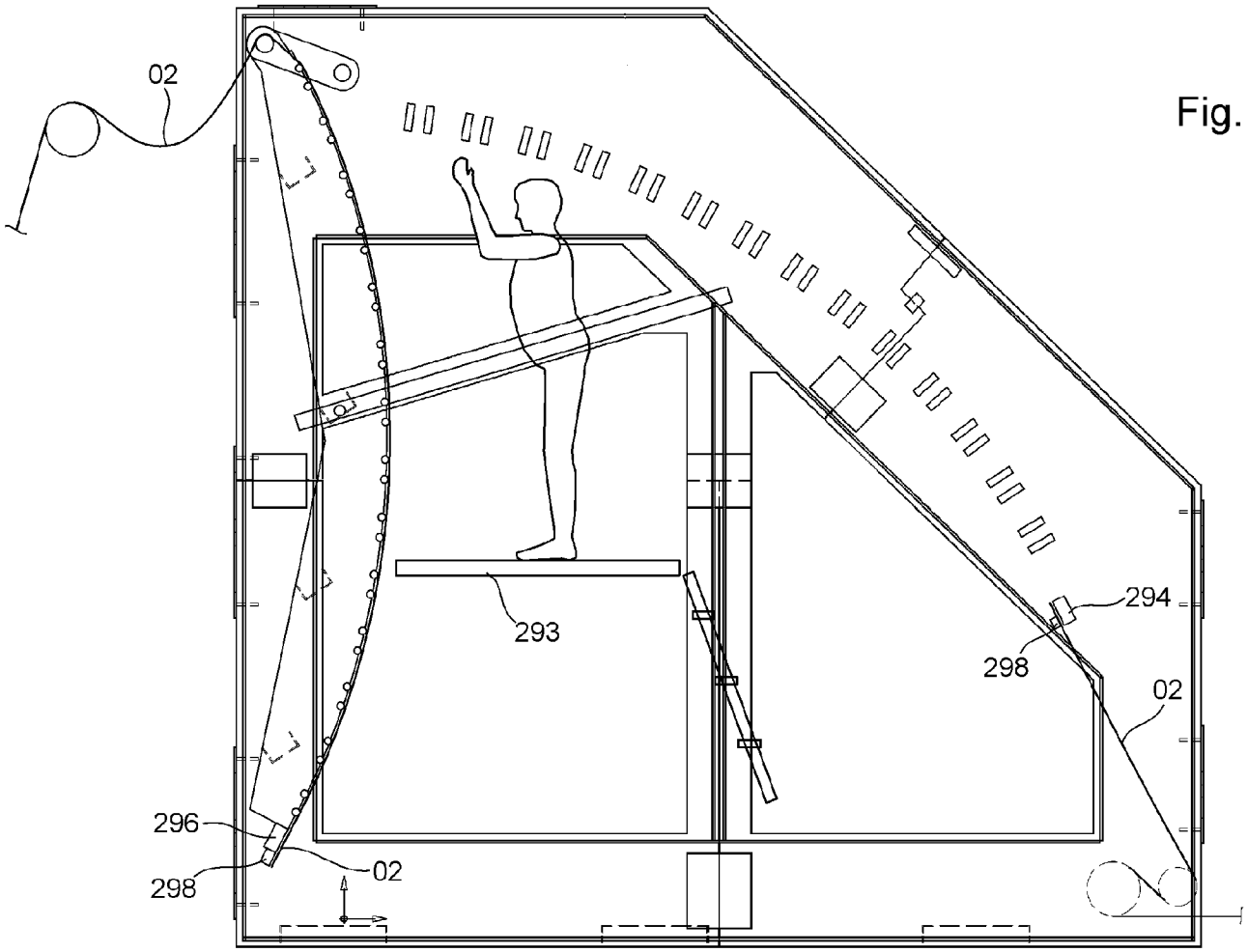
FIG. 7*b* a schematic diagram of a printing assembly with web fixing devices and guide elements in a maintenance position.
Figure 8A:
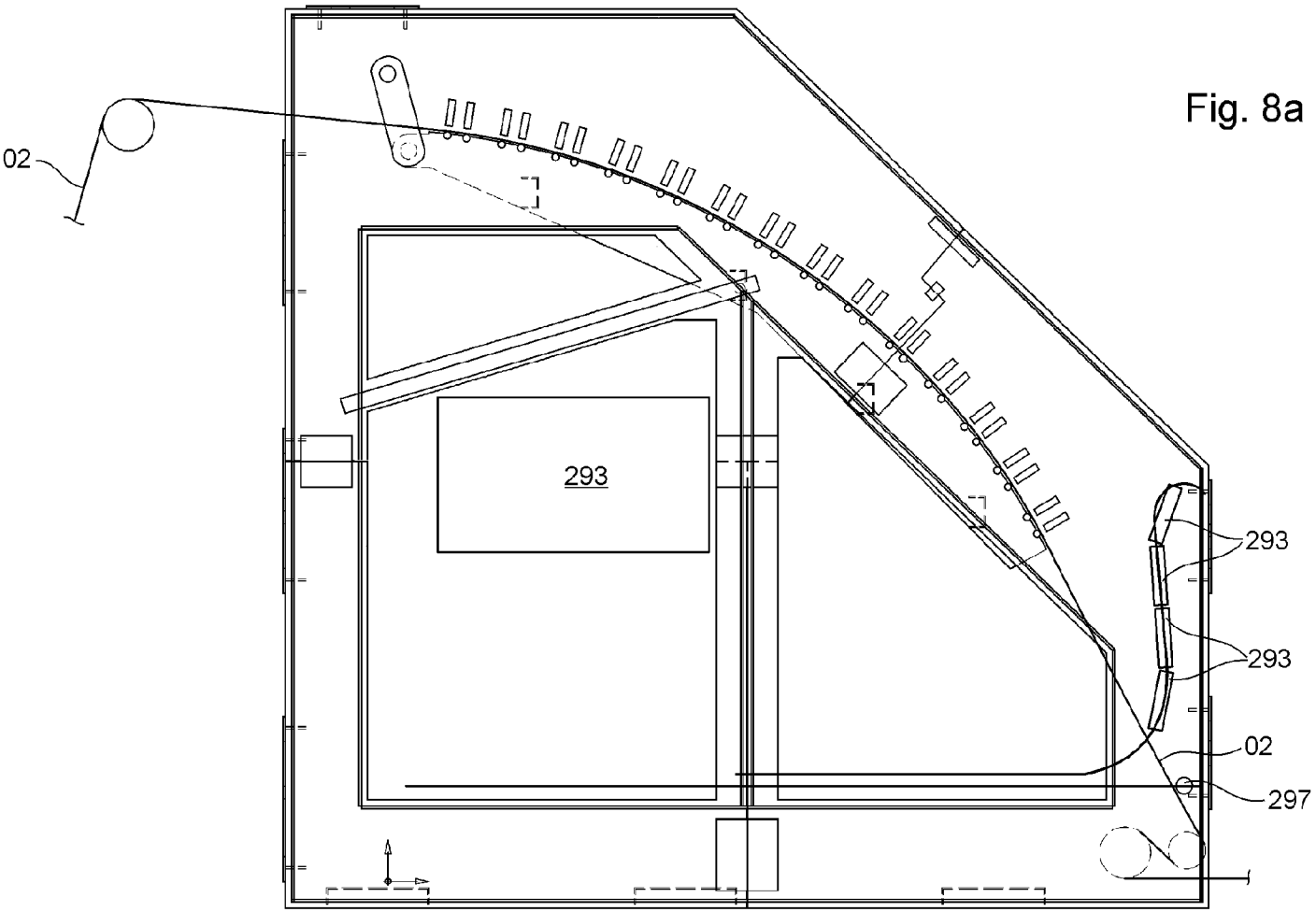
FIG. 8*a* a schematic diagram of a printing assembly with the redirecting device deactivated and with guide elements in a working position.
Figure 8B:
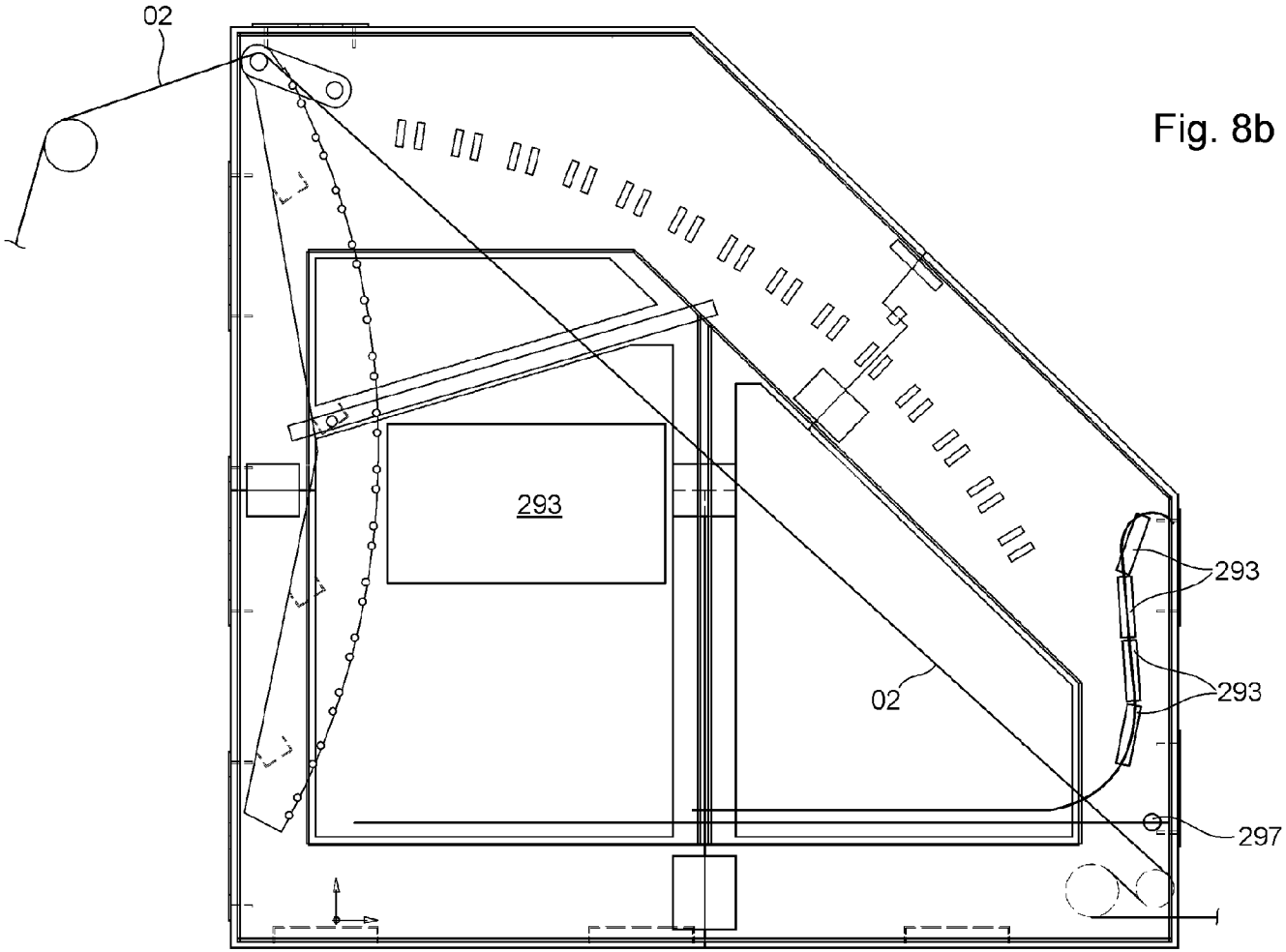
FIG. 8*b* a schematic diagram of a printing assembly with the turning device deactivated and with guide elements in a maintenance position.
Figure 8C:
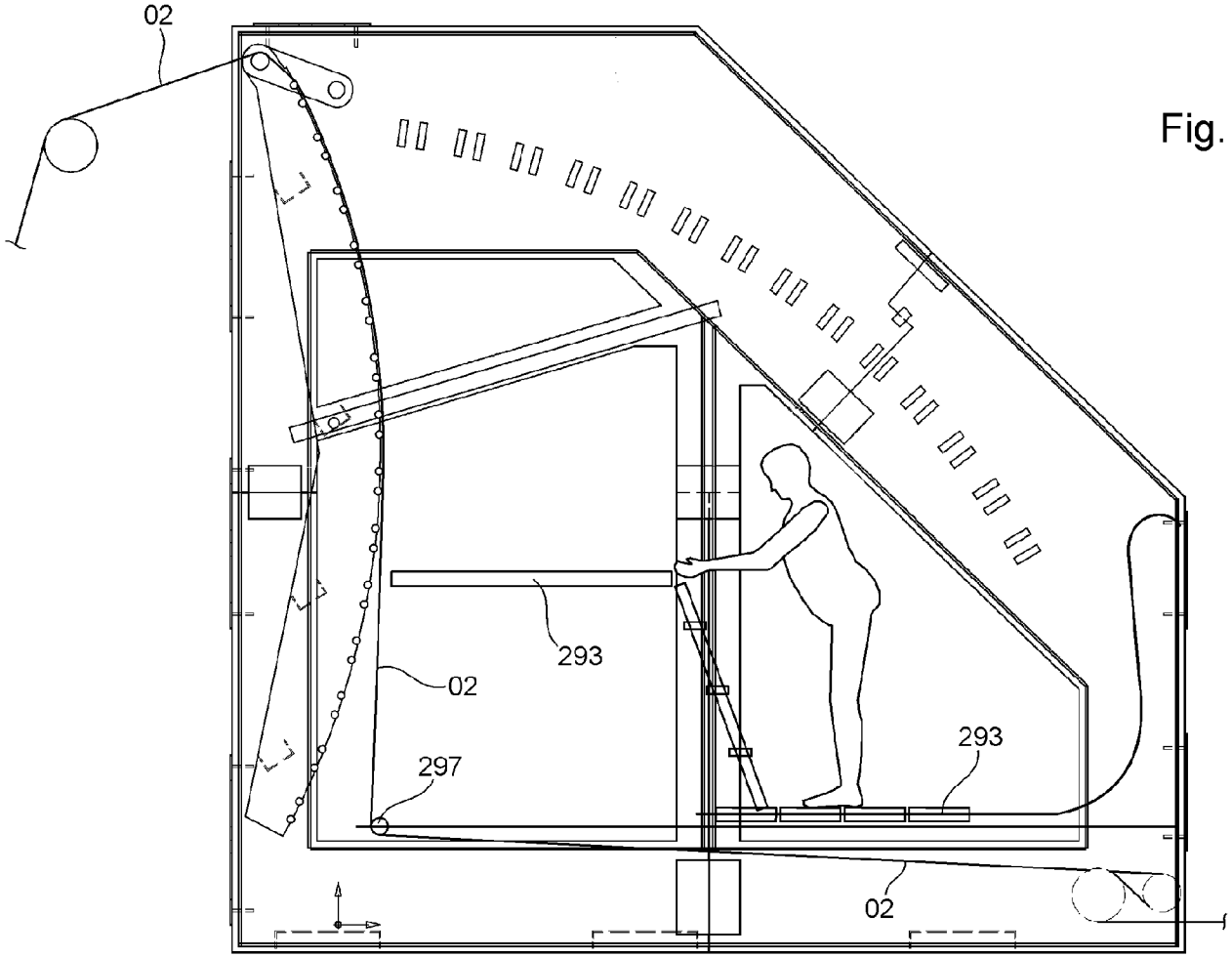
FIG. 8*c* a schematic diagram of a printing assembly with the turning device activated and with guide elements in a maintenance position.

The at least one printing assembly 200 preferably has a plurality of support positions 261 along printing section 226 of the transport path provided for printing substrate 02. Support positions 261 are preferably characterized by the fact that the provided transport path is influenced, for example changed, with respect to its transport direction at support positions 261. Said support positions 261 are preferably defined by respective guide elements 241. Guide elements 241 are preferably a component of printing substrate guiding unit 249. Guide elements 241 are preferably those devices that bound and deflect the transport path provided for printing substrate 02 and, in particular if printing substrate 02 is present, are preferably at least partially in contact with printing substrate 02. Possible guide elements 241 include corotating and/or positively driven cylinders and/or rollers and/or belt conveyor devices, however guide elements 241 are preferably configured as integral or multi-part stationary guide elements 241. A turning angle 227 of a guide element 241 is preferably an angle between a first local transport direction T1 and a second local transport direction T2, the first local transport direction T1 being a direction T1 of the transport path provided for printing substrate 02 in a region in which the provided transport path is approaching or is intended to approach guide element 241, and the second local transport direction T2 being a direction T2 of the transport path provided for printing substrate 02 in a region in which the provided transport path moves away from or is intended to move away from guide element 241. (This is also schematically illustrated in FIG. 2.) In particular, guide elements 241 are components of the conveying line. In particular, at least the guide elements 241 arranged in the region of printing section 226 of the transport path provided for printing substrate 02 are components of printing line 224.

Preferably, printing assembly 200 is alternatively or additionally characterized by the fact that the guide elements 241 that together define said transport path in the region of the printing section are stationary guide elements 241 with respect to movements in axial direction A. The at least two guide elements 241 that together define the provided transport path preferably each have an uninterrupted guide surface in the axial direction A over at least 25%, preferably at least 50%, more preferably at least 80% and even more preferably at least 100% of the working width of printing assembly 200. Preferably, the at least one guide element 241 extends in the transverse direction A over the entire working width of printing machine 01. A cross-section of the at least one guide element 241 is preferably an intersection of the at least one guide element with a plane, the surface normal of which is oriented parallel to the transverse direction A. Preferably, at least the part of the cross-section of the at least one guide element 241 that is in contact with the transport path provided for printing substrate 02 is the same as viewed over the working width of printing machine 01, in particular regardless of the position of the cross-section within the working region of the at least one first printing assembly 200 and/or regardless of the position of the cross-section with respect to transverse direction A. More preferably, the entire cross-section of the at least one guide element 241 is the same as viewed over the working width of printing machine 01, in particular independently of the position of the cross-section within the working region of the at least one first printing assembly 200 and/or regardless of the position of the cross-section with respect to transverse direction A.

Relatively flat guide elements 241 are conceivable, for example in the form of slightly bent plates. Preferably, however, the guide elements have a substantially cylindrical shell-shaped surface 228. The cross-section of the at least one guide element 241 preferably has at least one curved outer margin, in particular with a finite radius of curvature that is not equal to zero. This radius of curvature, and thus the radius of the guide elements 241, is preferably greater than 5 mm, more preferably greater than 10 mm and even more preferably greater than 13 mm. This radius of curvature, and thus the radius of the guide elements 241, is preferably less than 50 mm, more preferably less than 30 mm and even more preferably less than 18 mm. This curved outer margin preferably lies at least in a region of the cross-section that faces the transport region provided for the printing substrate 02. The curvature is, in particular, convex. More preferably, the entire outer margin of said cross-section is curved. Even more preferably, the margin of this cross-section is substantially circular.

The at least one guide element 241 preferably has an outer surface 228 in the shape of a cylindrical shell, at least in the region of the working width of printing machine 01 and/or the working width of the at least one first printing assembly 200, more preferably over the entire extension of the working width of printing machine 02 and even more preferably over the entire extension of the at least one guide element in transverse direction A. Preferably, the at least one guide element 241 is configured as at least one rod 241 with a substantially circular cross-section, in particular as a cylindrical rod 241. The axis of curvature of the surface 228 of rod 241 coincides, for example, with the center axis 229 of rod 241. Minimal flattened areas, for example caused by wear, should not be understood as deviations from the substantially circular cross-section. The outer surface 228 of the at least one guide element 241 is preferably formed by at least one friction-reducing surface, for example by a coating. For example, this outer surface 228 of the at least one guide element 241 is formed by a chromium coating. This outer surface 228 of the at least one guide element 241 is preferably the entire circumferential surface 228 of guide element 241, preferably configured as a rod 241, located in the region of the working width of printing machine 01. Preferably, a plurality of the guide elements 241, more preferably all of the guide elements 241 within printing line 224 of the at least one first printing assembly 200, are identical in construction.

Preferably, a plurality of such guide elements 241, in particular at least three, more preferably at least five and even more preferably at least fourteen, for example twenty-eight, are arranged one in front of the other with respect to the transport path provided for printing substrate 02. printing line 224 preferably has a plurality of such guide elements 241, in particular at least three, more preferably at least five and even more preferably at least fourteen, for example twenty-eight, arranged one in front of the other. The relative arrangement of guide elements 241 of printing line 224 defines a turning angle 227 for each guide element 241. The turning angles of guide elements 241 of printing line 224 are substantially equal and deviate from those of the remaining guide elements 241 of printing line 224 the most in the region of a first and/or a last guide element 241 of printing line 224. The turning angle 227 of guide elements 241 of printing line 224 is related to the number of print head rows 221 along printing line 224, the ejection directions of print heads 221 along printing line 224, and the number of guide elements 241 along printing line 224.

When reference is made in the foregoing and/or in the following to guide elements 241, preferably at least, and more preferably, only those guide elements 241 of printing line 224 are meant. The turning angle 227 of the at least one guide element 241 and more preferably of a plurality of and even more preferably of all of guide elements 241 is preferably at least 0.5° (zero point five degrees), more preferably at least 1° (one degree), and even more preferably at least 1.5° (one point five degrees). The turning angle 227 of the at least one guide element 241 and more preferably of a plurality of and even more preferably of all of guide elements 241 is preferably at most 10° (10 degrees), more preferably at most 5° (five degrees) and even more preferably at most 2.5° (two point five degrees).

Guide elements 241 of printing line 224 are preferably arranged along printing line 224 in the form of an arc, in particular a circular arc. Preferably, the guide elements 241 are arranged immovably or fixedly, each in at least one mounting device 271, and more particularly are immovable and/or fixed with respect to rotational movements about an axis of rotation that intersects the respective guide element 241. The respective at least one mounting device 271 can preferably be deactivated in terms of its mounting function, for example by releasing at least one locking device 272, in particular at least one screw 272. The at least one locking device 272 may be designed as a quick-release locking device, for example, which has at least one eccentric lever. The at least one mounting device 271 has at least one recess, for example, through which the corresponding guide element 241 projects, and said mounting device 271 has at least one borehole, which terminates in the at least one recess and into which a screw is threaded, the end of which is in contact with the corresponding guide element 241 so as to immobilize the corresponding guide element 241. Due to the preferred symmetry, in particular radial symmetry or even rotational symmetry, of guide elements 241, the corresponding guide element 241 can be released from its fixed position and then repositioned and re-secured in mounting device 271, rotated by a small angle, thereby providing a different, preferably as yet unused region of surface 228, in particular circumferential surface 228, of the corresponding guide element 241 for contact with printing substrate 02. Said angle is preferably a whole-numbered fraction of a full angle, that is, 360°/n, where n is a natural number. For example, the guide elements are rotationally symmetrical, for example, cylindrical. To facilitate correct positioning, at least at least one marking is preferably provided on the guide element and/or on mounting device 271, which provides a reference point for the relative positioning of guide element 241 and mounting device 271. At least at their end regions, guide elements 241 are not rotationally symmetrical, for example, and are instead only radially symmetrical, for example by a cross-section with an outer contour in the form of a regular polygon. This allows specific installation positions for guide elements 241 to be specified and, in the case of wear, facilitates a sufficiently large but not excessive manual rotation, for example to make optimal use of the circumference of guide elements 241 over the course of their service life.

At least one support element 273; 274 is preferably provided. The at least one support element 273; 274 preferably serves as a supporting device for the at least one guide element 241, more preferably for a plurality of guide elements 241 of printing line 224, and even more preferably for all the guide elements 241 of printing line 224. The at least one support element 273 is configured, for example, as at least one lateral support element 273. The at least one support element 273; 274 is preferably configured as at least one support frame 276 or as part of at least one support frame 276 which has at least two lateral support elements 273, for example, on which, in particular, a plurality of guide elements 241 are mounted, preferably directly and/or via mounting devices 271. The at least two lateral support elements 273 are preferably embodied as part of at least one support frame 276, and the at least one support frame 276 has at least one cross-member 277 that is different from guide elements 241 and extends at least in transverse direction A to ensure the constant relative positioning of lateral support elements 273. For example, the at least one support frame 276 has at least two cross-members 277 that are different from guide elements 241 and that extend at least in transverse direction A to ensure the constant relative positioning of lateral support elements 273. Constant relative positioning in this context preferably refers to the exclusion of any relative movement.

In principle, this function can be performed by the guide elements 241 themselves, in which case it should be noted that when all the guide elements 241 are released from support elements 273; 274, the lateral support elements 273 are no longer attached to one another. For reasons of stability, the provision of at least one cross-member 277 is preferred. The at least one lateral support element 273 preferably has at least one bearing region 278 per guide element 241, on which the respective guide element 241 rests on the lateral support element 273 or is at least in contact with the lateral support element 273. The at least one bearing region 278 is a component of the respective mounting device 271, for example, or preferably at least cooperates with the respective mounting device 271.

At least one inner support element 274 is preferably provided. The at least one inner support elements 274 is a component of the at least one support frame 276, for example. The at least one inner support element 274 preferably serves at least to protect one or more, or preferably all, of the guide elements 241 from undesirable sagging or at least from sagging to an undesirable degree. With large working widths of printing machine 01, if guide elements 241 were not supported they might otherwise sag near their center. The at least one inner support element 274 preferably is and/or can be rigidly connected to at least one of the at least two lateral support elements 273, for example to only one of the at least two lateral support elements 273. More preferably, the at least one inner support element 274 is and/or can be rigidly connected to the at least two lateral support elements 273. The at least one cross-member 277 that is different from the guide elements 241 preferably ensures a constant relative positioning of the lateral support elements 273 and the at least one inner support element 274. More preferably, at least two cross-members 277 that are different from the guide elements 241 ensure a constant relative positioning of the lateral support elements 273 and the at least one inner support element 274. In particular, the at least one inner support element 274 preferably is and/or can be rigidly connected via at least one bracing element 277 to at least one of the at least two lateral support elements 273, and more preferably, the at least one bracing element 277 is configured as cross-member 277, which is arranged in contact at least with the at least two lateral support elements 273.

Printing assembly 200 is preferably characterized by the fact that each contact surface between at least one inner support element 274 and at least one guide element 241 extends, with respect to axial direction A, over no more than 50%, more preferably no more than 25%, even more preferably no more than 10% and more preferably still no more than 5% of the working width of printing assembly 200. Contact between at least one inner support element 274 and at least one guide element 241 is preferably also provided in those cases in which said at least one guide element 241 is arranged so as to rotate around an individual rotational axis and/or is non-stationary.

The at least one inner support element 274 preferably has at least one bearing region 278 per guide element 241, on which the respective guide element 241 rests on the inner support element 274 or is at least in contact with the inner support element 274. The at least one bearing region 278 is preferably embodied as a concave bearing region 278, more preferably as having a concave surface that corresponds to part of a surface of a cylinder shell and has the shape of a circular segment in cross-section. The internal angle of said circular segment is preferably greater than 180°, for example approximately 270°. For the purpose of assembly, the corresponding guide element 241 can then be inserted into inner support element 274, for example in transverse direction A. A stable arrangement can thereby be achieved. More preferably, the inner radius of bearing region 278 is adapted to the radius of outer surface 228 of the at least one guide element 241, in particular is identical thereto. Alternatively, other shapes may also be provided for this cross-section of bearing region 278, for example consisting of several straight segments.

Since guide elements 241 would be expected to experience wear essentially only in the region where there is wrap, with the angular range of said wear corresponding to the turning angle 227, it is possible for each guide element 241 to be reused multiple times when it has become worn, by rotating said guide element about an angle that is somewhat greater, for example, than the turning angle 227, and then reinstalling said guide element. As a result, even when guide element 241 has become worn down multiple times over its cross-section, there will still be many locations remaining where the outermost point on surface 228 still corresponds to the original outer circular line of the cross-section. These locations preferably serve to brace guide element 241 with respect to the at least one inner support element 274. In this way, even if guide element 241 is partially worn off, it can still be ensured that sagging is effectively reduced or even prevented.

The wider the working width of the printing machine, the more inner guide elements 241 can be provided, so that the maximum distance between individual positions that brace guide element 241 can be minimized regardless of the dimension of the working width of printing machine 01. The distance between adjacent support elements 273; 274 is preferably less than two meters, more preferably less than one-and-a-half meters, and even more preferably less than one meter. The distance between adjacent support elements 273; 274 is preferably greater than 5 cm, more preferably greater than 10 cm, and even more preferably greater than 30 cm.

One print head row 222 is preferably assigned to each guide element 241. Alternatively, a plurality of print head rows 222 could be assigned to each guide element 241, for example if the guide elements 241 were designed as flat guide elements rather than as rods. Preferably, one guide element 241 is assigned to each print head row 222. Each nozzle of the print heads 221 preferably has a respective ejection direction. Preferably, all the nozzles of the same print head 221 have the same ejection direction. Preferably at least one, and more preferably each print head 221 of the at least one first printing assembly 200 has at least one nozzle, the imaginary extension of which in the ejection direction intersects with a guide element 241, in particular with the guide element 241 assigned to said respective print head 221, when the print head 221 is arranged in the printing position and the guide element 241 is arranged in the working position. More preferably at least one and even more preferably each print head 221 of the at least one first printing assembly 200 has a plurality of nozzles, the imaginary extension of which in the ejection direction intersects with a guide element 241, in particular with the guide element 241 assigned to said respective print head 221, when the print head 221 is arranged in the printing position and the guide element 241 is arranged in the working position. More preferably at least one and even more preferably each print head 221 of the at least one first printing assembly 200 has exclusively such nozzles, the imaginary extension of which in the ejection direction intersects with a guide element 241, in particular with the guide element 241 assigned to said respective print head 221, when the print head 221 is arranged in the printing position and the guide element 241 is arranged in the working position.

The shortest distance between a particular nozzle of a respective print head 221 arranged in its printing position on one side and the transport path provided for the printing substrate 02 or the closest guide element 241 arranged in its working position on the other side is preferably at least 0.1 mm, more preferably at least 0.5 mm and even more preferably at least 1.0 mm and is preferably no more than 5 mm, more preferably no more than 3.0 mm and even more preferably no more than 2.0 mm. The shortest distance between a particular nozzle of a respective print head 221 arranged in its printing position on one side and the printing substrate 02 on the other side is preferably at least 0.1 mm, more preferably at least 0.5 mm and even more preferably at least 1.0 mm and is preferably no more than 5 mm, more preferably no more than 3.0 mm and even more preferably no more than 2.0 mm. These distances are related to one another over the thickness of printing substrate 02.

At least one shielding device 292 is preferably provided. The at least one shielding device 292 preferably serves to shield parts of the print heads, for example the devices thereof for supplying power to electronic components and/or for supplying printing fluid and/or the mountings thereof and/or parts of nozzle bars 231, from the transport path provided for printing substrate 02, and in particular the printing section 226 thereof and/or from a region that includes the nozzles of print heads 221. In this way, printing fluid is prevented from being deposited as soiling on those parts of the print heads 221 that might be impaired by this, for example in the form of a fine ink mist. The at least one shielding device 292 preferably has at least one opening per print head 221, through which the respective print head 221 or at least the nozzles thereof can protrude at least partially, and can protrude even when print head 221 is arranged in its printing position. The openings are preferably substantially sealed off by the print heads 221 arranged in their printing positions. The at least one shielding device 292 is configured, for example, as at least one shielding surface 292, in particular as at least one shielding plate 292. The at least one shielding device 292 is preferably arranged immovably relative to a stand 283 of the at least one first printing assembly 200, in particular independently of whether the at least one print head 221 is arranged in its printing position or in its thrown-off position and/or independently of whether the at least one guide element 241 and/or the support frame 276 is arranged in its working position or in its maintenance position.

At least rotatable first web guiding means 251 is preferably located upstream of the first guide element 241 of printing line 224 with respect to the transport path provided for printing substrate 02. Said at least one first rotatable web guiding means 251 is preferably embodied as a first motorized web guiding means 251 and/or as a first web guiding roller 251, in particular as a first motorized web guiding roller 251. The at least one first web guiding roller 251 has its own drive motor, for example, and/or the at least one first web guiding roller 251 is part of at least one system for regulating the web tension of a web-type printing substrate 02. Alternatively or additionally, at least one additional web guiding roller 252 is embodied as a motorized web guiding roller 252, which is arranged immediately upstream of the first web guiding roller 251 with respect to the transport path provided for printing substrate 02, or with the additional web guiding rollers 253 and/or web guiding means 253 therebetween.

At least one rotatable second web guiding means 254 is preferably located downstream of the last guide element 241 of printing line 224 with respect to the transport path provided for printing substrate 02. This at least one second rotatable web guiding means 254 is preferably embodied as a second motorized web guiding means 254 and/or a second web guiding roller 254, in particular a second motorized web guiding roller 254. For example, the at least one second web guiding roller 254 has its own drive motor and/or the at least one second web guiding roller 254 is part of the at least one system for regulating the web tension of the web-type printing substrate 02. Alternatively or additionally, at least one additional web guiding roller 256 is embodied as a motorized web guiding roller 256, which is located immediately downstream of the second web guiding roller 254 with respect to the transport path provided for printing substrate 02, or with additional web guiding rollers 257 and/or web guiding means 257 therebetween. Web guiding means 251; 253; 254; 257 and/or web guiding rollers 251; 252; 253; 254; 256; 257 are preferably components of printing substrate guiding unit 249.

Printing section 226 of the transport path provided for printing substrate 02 preferably ascends monotonically. The first guide element 241 of printing line 224 is preferably positioned lowest of all the guide elements 241 in printing line 224. The last guide element 241 in printing line 224 is preferably positioned highest of all the guide elements 241 in printing line 224.

The at least one printing assembly 200 preferably has at least one, and more preferably precisely one, pivot device 279. The at least one pivot device 279 is preferably assigned to at least one, more preferably to multiple and even more preferably to all the guide elements 241 of printing line 224.

Preferably a plurality of guide elements 241 and more preferably all the guide elements 241 of printing line 224 are arranged so as to pivot, in particular each along an individual pivot path and/or each along a pivot path of different length, about at least one common pivot axis 281; 282, in particular by means of the at least one pivot device 279. Said at least one common pivot axis 281; 282 is preferably at least one pivot axis 281; 282 of pivot device 279 of the at least one printing assembly 200. For example, at least one support element 273; 274, in particular at least one lateral support element 273 and/or at least one inner support element 274 together with the guide elements 241 and/or at least one support frame 276 are arranged so as to pivot about the at least one common pivot axis 281; 282, in particular each along a respective pivot path. The at least one support frame 276 is preferably arranged so as to pivot about the at least one common pivot axis 281; 282.

Each guide element 241 that can pivot about the at least one common pivot axis 281; 282 is preferably assigned a working position and a maintenance position. The working position of each guide element 241 is preferably characterized by the fact that during a printing operation, guide element 241 is in its working position and/or by the fact that the shortest distance between the guide element 241 arranged in its working position and the print head 221 closest to said guide element and arranged in its printing position is no more than 5 mm, more preferably no more than 3.0 mm and even more preferably no more than 2.0 mm, and/or by the fact that the transport path provided for the printing substrate 02 during printing operation forms a tangent with the guide element 241 arranged in its working position. The maintenance position of each guide element 241 is preferably characterized by the fact that when the at least one first printing assembly 200 is in a maintenance mode, the guide element 241 is in its maintenance position, and/or by the fact that the shortest distance between the guide element 241 arranged in its maintenance position and the print head 221 that is closest to said guide element and is arranged in its printing position is at least 5 cm, more preferably at least 10 cm and even more preferably at least 20 cm, and/or by the fact that in its maintenance position, the guide element 241 is spaced from the transport path provided for the printing substrate 02 during printing operation.

The at least one common pivot axis 281; 282 of the at least one pivot device 279 is preferably situated above the working position and/or the maintenance position of the first guide element 241 of printing line 224, as viewed in the transport direction of printing substrate 02. The at least one common pivot axis 281; 282 is preferably located above the working position and/or the maintenance position of each guide element 241 of printing line 224 that is assigned to a middle one-third of printing line 224 in the transport direction of printing substrate 02. A vertical component of the distance between the at least one first guide element 241 of printing line 224 and the at least one common pivot axis 281; 282 is preferably at least twice as large as a vertical component of the distance between the at least one last guide element 241 of printing line 224 and the at least one common pivot axis 281; 282, more preferably at least three times as large and even more preferably at least four times as large, in particular regardless of whether the at least one support frame 276 is in its working position or its maintenance position.

In a preferred first embodiment of pivot device 279, pivot device 279 has precisely one common pivot axis 281. In this first embodiment of pivot device 279, the at least one support element 273; 274 and in particular the at least one support frame 276 can be pivoted about a single common pivot axis 281, in particular relative to a stand 283 of the at least one first printing assembly 200. In this first embodiment, the at least one guide element 241 of printing line 224 is preferably pivotable about said single common pivot axis 281, in particular relative to stand 283 of the at least one first printing assembly 200. More preferably, in this first embodiment, a plurality and more preferably all of the guide elements 241 of printing line 224 are pivotable about this single common pivot axis 281, in particular relative to stand 283 of the at least one first printing assembly 200.

In a second embodiment of pivot device 279, pivot device 279 has at least two and preferably precisely two common pivot axes 281; 282 and at least one intermediate link 284. The at least one intermediate link 284 is preferably pivotable about a first common pivot axis 281 relative to stand 283 of the at least one first printing assembly 200. In this second embodiment of pivot device 279, the at least one support element 273; 274 and in particular the at least one support frame 276 is pivotable about a second common pivot axis 282, in particular relative to intermediate link 284. In that case, in particular, the second common pivot axis 282 itself is preferably not immovable, but movable, in particular pivotable about the first common pivot axis 281. In this second embodiment, the at least one guide element 241 of printing line 224 is preferably pivotable about this second common pivot axis 282, in particular relative to intermediate link 284 and/or relative to stand 283. More preferably, in this second embodiment, a plurality and even more preferably all of the guide elements 241 of printing line 224 are pivotable about this second common pivot axis 282, in particular relative to intermediate link 284 and/or relative to stand 283.

The at least one pivot device 279 preferably has at least one, in particular common pivot drive 286. The at least one pivot drive 286 has at least one linear drive 286, for example. The at least one pivot drive 286, in particular linear drive 286, preferably engages with at least one first connecting element on stand 283, for example directly or with at least one additional component therebetween. The at least one pivot drive 286, in particular linear drive 286, preferably engages with at least one second connecting element on at least one support element 273; 274 and/or at least one cross-member 277 and/or the support frame 276, for example directly or with at least one additional component therebetween. As pivot drive 286, for example, at least one fluid piston is provided, for example at least one hydraulic piston and/or at least one pneumatic piston, and/or more preferably, at least one electric motor is provided, which cooperates with at least one threaded spindle and/or at least one toothed rack and/or at least one gear wheel, for example. At least at least one articulated joint and/or at least one spindle and/or at least one spindle nut or the like is provided, for example, as connecting elements and/or as the additional component. The at least one pivot drive preferably serves to effect a pivoting movement of the at least one support element 273; 274 and/or the at least one cross-member 277 and/or the at least one support frame 276 and/or in particular the guide elements 241. Alternatively or additionally, the at least one linear drive 286 can be used to move the leading end of a flexible traction means, in particular a chain, linearly, the traction means being deflected around at least one and preferably around at least two turning devices, with one end of the traction means being connected to the at least one support frame 276. When the leading end of the traction means is moved linearly, the traction means will pull the support frame 276 upward, thereby pivoting said support frame about the at least one pivot axis 281; 282. Use of the flexible traction means allows a pivoting movement of support frame 276, in particular about a single pivot axis 281, to be achieved using a linear drive 286 because the flexible traction means does not require a fixed movement path.

In connection with the first embodiment of pivot device 279, and as a part of the at least one pivot device 279, for example, at least one linear guide that is flexible, in particular pivotable with respect to its linear axis of movement is provided, along which, for example, at least one slide element is guided, or which further preferably comprises at least one piston that is pivotable relative to stand 283. The piston engages, for example, at a connecting point on the at least one support element 273; 274 and/or the at least one cross-member 277 and/or the at least one support frame 276, the connecting point preferably being pivotable about the first common pivot axis 281. When the at least one support element 273; 274 and/or the at least one cross-member 277 and/or the at least one support frame 276 and/or the at least one guide element 241 executes a pivoting movement, the alignment of the linear axis of movement of the linear guide then also changes.

In connection with the second embodiment of pivot device 279, for example, as part of the at least one pivot device 279, at least one linear guide 287 that is preferably constant with respect to its linear axis of movement is preferably provided, along which at least one slide element is preferably guided. The at least one slide element is preferably assigned to a connecting point 288 of the at least one support element 273; 274 and/or the at least one cross-member 277 and/or the at least one support frame 276, and ensures that said connecting point 288 travels a substantially linear path during movement of the guide elements 241 and/or the at least one support element 273; 274 and/or the at least one cross-member 277 and/or the at least one support frame 276 between the working position and the maintenance position. The provision of the two common pivot axes 281; 282 enables a linear guidance of said connecting point 288 of the at least one support element 273; 274 and/or the at least at least one cross-member 277 and/or the at least one support frame 276.

Preferably independently of the embodiment of the at least one pivot drive 286 and/or independently of the number of common pivot axes 281; 282, the at least one pivot device 279 preferably has at least one securing element, more preferably at least two securing elements, and even more preferably at least four securing elements. The at least one securing element preferably serves to secure the guide elements 241 and/or the at least one support element 273; 274 and/or the at least one cross-member 277 and/or in particular the at least one support frame 276 in their respective working positions. Preferably a plurality and more preferably all of the guide elements 241 of printing line 224 can be secured together in their respective working positions by means of the at least one securing element. For example, said plurality of or all of the guide elements 241 of the printing line 224 are arranged stationary relative to the at least one support frame 276, and the at least one support frame 276 is and/or can be fixed relative to the stand 283 of the at least one first printing unit 200 by means of the at least one fixing element. For example, the at least one support frame 276 can be arranged precisely in its working position by means of the at least one pivot drive 286, and then the at least one locking device is used only for securing said frame. Preferably, the at least one support frame 276 can be situated substantially in its working position by means of the at least one pivot drive 286, and then the at least one locking device is used for precisely positioning the at least one support frame 276 and securing the at least one support frame.

The at least one locking device has, for example, at least one stop and at least one contact element and at least one force exerting device, embodied, for example, as at least one traction device and/or compression device. The at least one force exerting is preferably used for pulling and/or pressing the at least one contact element against the at least one stop. For each securing element, one cotter is provided, for example, the inclined surface of which converts a direction of linear movement and/or force into a linear movement and/or force that is oriented in terms of its direction with at least one component that is orthogonal thereto. By selecting the angle appropriately, self-locking is preferably achieved. For example, the at least one stop and the at least one force exerting device are located on the stand 283 of the at least one first printing assembly 200, and the at least one contact element is located on the at least one support frame 276.

The at least one locking device enables, in particular, a reproducible and/or precisely adjustable positioning of the at least one support element 273; 274 and/or the at least one support frame 276 and/or the guide elements 241 of the printing line 224 relative to the stand 283 of the at least one first printing assembly 200. With a preferably reproducible and/or precisely adjustable positioning of print heads 221 relative to the stand 283 of the at least one first printing assembly 200, a reproducible and/or precisely adjustable positioning of the print heads 221 relative to the guide elements 241 of the printing line can thus be achieved.

A main conveying direction B is preferably defined by a rectilinear connection between a first guide element 241 in the printing line 224 with respect to the transport path provided for printing substrate 02 and a last guide element 241 of the printing line 224 with respect to the transport path provided for printing substrate 02. Main conveying direction B is preferably defined by a rectilinear connection between a first guide element 241 with respect to the printing section 226 of the transport path provided for printing substrate 02 and a last guide element 241 with respect to the printing section 226 of the transport path provided for printing substrate 02. Main conveying direction B is oriented from the first guide element 241 of the printing line 224 with respect to the transport path provided for printing substrate 02 toward the last guide element 241 of the printing line 224 with respect to the transport path provided for printing substrate 02. Main conveying direction B is preferably oriented orthogonally to transverse direction A.

The alignment of main conveying direction B when guide elements 241 are arranged in their working position and/or when support frame 276 is arranged in its working position is independent of the alignment of main conveying direction B when guide elements 241 are arranged in their maintenance position and/or when support frame 276 is arranged in its maintenance position, for example. Preferably, however, the alignment of main conveying direction B when guide elements 241 are arranged in their working position and/or when support frame 276 is arranged in its working position is at an angle of at least 10°, more preferably at least 20° and even more preferably at least 30° from the alignment of main conveying direction B when guide elements 241 are arranged in their maintenance position and/or when support frame 276 is arranged in its maintenance position.

Preferably, when guide elements 241 are arranged in their working position and/or when support frame 276 is arranged in its working position, main conveying direction B has at least one vertically upward-pointing component and at least one horizontal component. When guide elements 241 are arranged in their working position and/or when support frame 276 is arranged in its working position, main conveying direction B is preferably aligned at an angle of at least 10°, more preferably at least 20° and even more preferably at least 30° in relation to a horizontal plane. When guide elements 241 are arranged in their working position and/or when support frame 276 is arranged in its working position, main conveying direction B is preferably aligned at an angle of no more than 70°, more preferably no more than 55° and even more preferably no more than 40° in relation to a horizontal plane. In an alternative embodiment, main conveying direction B would extend substantially horizontally, that is to say at an angle of no more than 5° in relation to a horizontal plane.

When guide elements 241 are arranged in their maintenance position and/or when support frame 276 is arranged in its maintenance position, main conveying direction B preferably has at least one vertically upward-pointing component and more preferably has exclusively a vertically upward-pointing component. When guide elements 241 are arranged in their maintenance position and/or when support frame 276 is arranged in its maintenance position, main conveying direction B is preferably aligned at an angle of no more than 30°, more preferably no more than 20° and even more preferably no more than 10° in relation to a vertical direction.

To transfer guide elements 241 of printing line 224 from their working position to their maintenance position and/or to transfer the at least one support frame 276 from its working position to its maintenance position, the at least one pivot drive 286 is preferably activated. Preferably, guide elements 241 and/or the at least one support frame 276 are pivoted from their respective working positions to their respective maintenance positions, more preferably about the at least one first common pivot axis 281 and/or about the at least one second common pivot axis 282. The pivoting movement in this case preferably has at least one downward-pointing component. The pivoting movement is preferably carried out at a pivot angle of at least 10°, more preferably at least 20° and even more preferably at least 30°.

To transfer guide elements 241 of printing line 224 from their maintenance position to their working position and/or to transfer the at least one support frame 276 from its maintenance position to its working position, the at least one pivot drive 286 is preferably activated. Preferably, guide elements 241 and/or the at least one support frame 276 are pivoted from their respective maintenance positions to their respective working positions, more preferably about the at least one first common pivot axis 281 and/or about the at least one second common pivot axis 282. The pivoting movement in this case preferably has at least one upward-pointing component. The pivoting movement is preferably carried out at a pivot angle of at least 10°, more preferably at least 20° and even more preferably at least 30°.

The joint pivotability of guide elements 241 of printing line 224 and/or the pivotability of the at least one support frame 276 preferably makes it possible for the distance between the nozzles of the print heads and/or the at least one shielding device 292 on one side and the guide elements 241 of the printing line 224 on the other side to be increased. As a result of the pivoting movement, this increase impacts different guide elements 241 to different degrees. The joint pivotability of guide elements 241 of printing line 224 and/or the pivotability of the at least one support frame 276 thus results in a maintenance space 291 between the nozzles of the print heads 221 and/or the at least one shielding device 292 on one side and the guide elements 241 on the other side. Said maintenance space 291 is accessible to operators, for example. Said maintenance space 291 allows the guide elements 241 of printing line 224 to be maintained and/or cleaned, for example, in particular regardless of the working width of printing machine 01. Said maintenance space 291 allows the at least one shielding device 292 to be maintained and/or cleaned, for example, in particular independently of the working width of printing machine 01.

The at least one first printing assembly 200 preferably has at least one first movable standing support 293, in particular platform 293. The at least one first movable standing support 293 can preferably be arranged at least in one position of use and can preferably be positioned at least in one standby position. When standing support 293 is arranged in its position of use, standing support 293 is preferably located within the maintenance space 291 and/or allows at least one operator access to the maintenance space 291. Preferably, the at least one first movable platform 293 is arranged so as to move, for example pivotably and/or linearly, along a deployment path between its at least one standby position and it's at least one position of use.

For example, the at least one deployment path of the at least one standing support 293 on one side and the respective pivot path of at least one or more guide elements 241 and/or of the at least one support element 273; 274 and/or of the at least one support frame 276 on the other side intersect. For this reason, the at least one support frame 276 and/or the guide elements 241 are preferably first moved, in particular pivoted, from their respective working positions to their respective maintenance positions, with the at least one first standing support 293 being moved preferably from its standby position into its position of use. Once a use of the at least one standing support 293 has been completed, the at least one first standing support 293 is preferably first moved from its position of use to its standby position, after which the at least one support frame 276 and/or the guide elements 241 are moved, in particular pivoted, from their respective maintenance positions into their respective working positions. As an alternative or in addition to a pivotable standing support 293, a standing support 293 that can be moved along at least one guide curve is also provided, for example, which preferably consists of a plurality of individual sections that can be moved together or separately.

Since the guide elements 241 in their maintenance position are located at a distance from the transport path provided for the printing substrate 02, in particular farther from said path than in their working position, printing substrate 02 that is already present in the at least one first printing assembly 200 must be handled accordingly.

In a preferred first embodiment of a handling of printing substrate 02, printing substrate 02 is preferably severed. Preferably, at least one first web fixing device 294 and one second web fixing device 296 are provided. For example, the at least one first web fixing device 294 and/or the at least one second web fixing device 296 is embodied as a suction device and preferably has at least one opening that can be pressurized with a vacuum. Alternatively or additionally, the at least one first web fixing device 294 and/or the at least one second web fixing device 296 are each embodied as a clamping device, for example. In particular, the at least one first web fixing device 294 and/or the at least one second web fixing device 296 each have at least one in particular movable permanent magnet, for example. In that case, the method for operating web fixing device 294; 296 configured as a clamping device involves, for example, one or preferably a plurality of movable, in particular magnetic clamping elements being placed on a surface of printing substrate web 02 and at least one clamping element configured as a counter piece, which is embodied, for example, as at least one contact surface and/or which is itself magnetic, for example, being arranged on an opposite side of printing substrate web 02. The clamping elements are then pressed against one another by force of magnetic attraction, and the printing substrate web 02 arranged therebetween is clamped. The movable clamping elements are positioned manually, for example. A plurality of movable clamping elements are preferably provided for each web fixing device 294; 296, for example at least three each. Alternatively, the at least one movable clamping element is configured as actuable by means of a drive. In that case, printing assembly 200 is characterized, for example, in that the at least one first web fixing device 294 and/or the at least one second web fixing device 296 has at least one electric and/or at least one pneumatic and/or at least one hydraulic drive.

The at least one first web fixing device 294 is preferably at least partially located on stand 283 of the at least one first printing assembly 200 and/or is at least partly immovable relative to stand 283 of the at least one first printing assembly 200. The at least one second web fixing device 296 is preferably arranged so as to move together with guide elements 241. For example, the at least one second web fixing device 296 is at least partially immovable relative to the at least one support frame 276 and/or is arranged at least partially on the at least one support frame 276. The at least one first web fixing device 294 and/or the at least one second web fixing device 296 are preferably first activated and thus hold printing substrate web 02. More particularly, the at least one first web fixing device 294, at least if it is embodied as a suction device, preferably holds a first section of the printing substrate web 02 from a side of the printing substrate web 02 that faces print heads 221. For example, the at least one second web fixing device 296, at least if it is embodied as a suction device, preferably holds a second section of the printing substrate web 02 from a side of printing substrate web 02 that faces away from print heads 221 and faces toward guide elements 241. The first section is preferably situated further downstream than the second section with respect to the direction of transport of printing substrate 02.

Afterward, for example, printing substrate web 02 is preferably severed, in particular between the at least one first web fixing device 294 and the at least one second web fixing device 296. Guide elements 241 and/or the at least one support frame 276 are then preferably pivoted about the at least one common pivot axis 281; 282, and the part of printing substrate web 02 that is held by the second web fixing device 296 is preferably pivoted with them. As a result, maintenance space 291 is created, the based area of which is preferably freely accessible. Once the corresponding maintenance tasks have been completed, for example on the at least one shielding device 292, guide elements 241 are moved, in particular pivoted, back to their working position. Second web fixing device 296 is thereby preferably pivoted back to its the initial position, together with the part of the printing substrate web 02 that is held by it. The two ends of printing substrate web 02 are thus located in immediate proximity to one another again. These two ends of printing substrate web 02 are then preferably joined again, for example by splicing. A process of transporting printing substrate 02 and/or a previously interrupted printing process can then be continued.

Preferably, printing assembly 200 is alternatively or additionally characterized by the fact that along this first provided transport path, in the region of the first web fixing device 294 and/or in the region of the second web fixing device 296 and in particular between the at least one first web fixing device 294 and the at least one second web fixing device 296, at least one connecting region of at least one connecting aid 298 is located, said at least one connecting aid 298 preferably being at least one connecting aid for connecting at least two ends of printing substrate webs 02. The at least one connecting aid 298 preferably has at least one first contact surface and/or at least one second contact surface. The at least one connecting aid is characterized, for example, in that the at least one first contact surface is assigned to the at least one first web fixing device 294 and/or is embodied as part of the at least one first web fixing device 294 and/or is disposed at least partially immovably relative to stand 283 of the at least one first printing assembly 200 and/or at least partially on stand 283 of the at least one first printing assembly 200. The at least one connecting aid is characterized, for example, in that the at least one second contact surface is assigned to the at least one second web fixing device 296 and/or is embodied as part of the at least one second web fixing device 296 and/or is disposed at least partially immovably relative to the at least one support frame 276 and/or at least partially on the at least one support frame 276. The at least one first contact surface is embodied, for example, as a clamping element, on which clamping elements that are movable as a counter piece act. The at least one second contact surface is embodied, for example, as a clamping element, on which clamping elements that are movable as a counter piece act.

The at least one first contact surface extends, for example, over at least 80% and preferably over at least 100% of the working width of printing assembly 200. The at least one second contact surface extends, for example, over at least 80% and preferably over at least 100% of the working width of printing assembly 200. The printing assembly is preferably characterized by the fact that when guide elements 241 are in their working positions, the at least one first contact surface and the at least one second contact surface are spaced by a minimal distance of no more than 100 mm, more preferably no more than 50 mm, even more preferably no more than 20 mm, even more preferably no more than 10 mm and more preferably still no more than 5 mm. A connection is thereby facilitated, for example because a relatively small gap is present in a surface that is intended to support the ends of the printing substrate web 02 while a splicing tape strip is being affixed.

In a second embodiment for the handling of printing substrate 02, printing substrate 02 preferably is not severed, and instead the position of the printing substrate web 02 is changed. At least one turning device 297 is preferably provided for this purpose, and is more preferably movable. The at least one turning device 297 is embodied as at least one rod or roller, for example, which extends in transverse direction A. For example, at least during a printing operation, the at least one turning device 297 is located on the side of printing substrate 02 and/or of the provided transport path that is assigned to print heads 221. For example, the at least one turning device 297 is movable along an adjustment path that intersects the provided transport path. The at least one turning device 297 is movable, in particular pivotable, together with the at least one support frame 276, for example, and is preferably located on the at least one support frame 276. More preferably, the at least one turning device 276 is movable independently of the guide elements 241 and/or the support frame 276, for example by means of a separate drive and/or along a separate guide, which extends linearly, for example, in particular horizontally. In this manner, by pivoting the at least one support frame 276, first a distance between guide elements 241 and the printing substrate can be created, through which, for example, guide elements 241 can be accessed for a maintenance procedure, after which, in particular, printing substrate web 02 can be moved away from print heads 221 and/or from the at least one shielding device 292 by a movement of the at least one turning device 297, for example to allow the at least one shielding device 292 to be cleaned on the side facing the provided transport path. To be able to print again, the corresponding steps are preferably carried out in reverse order.

At least one threading means that is movable along at least one threading path for threading in a printing substrate web 02 and/or at least one threading means that is movable along at least one provided transport path for printing substrate web 02 for threading in a printing substrate web 02 preferably is and/or can be arranged, at least intermittently, at least within the at least one printing assembly 200 and more preferably in additional areas of printing machine 01. At least parts of the at least one threading path, and more preferably the entire threading path, are spaced with respect to transverse direction A from every target region of every nozzle of every print head 221 of the at least one first printing assembly 200 by a distance of at least 2 cm, more preferably at least 4 cm, even more preferably at least 6 cm and more preferably still at least 8 cm. At least parts of the threading means, and more preferably the entire threading means are preferably spaced with respect to transverse direction A from every target region of every nozzle of every print head 221 of the at least one first printing assembly 200 by a distance of at least 2 cm, more preferably at least 4 cm, even more preferably at least 6 cm and more preferably still at least 8 cm. In particular, the at least one threading path and/or the at least one threading means is preferably arranged outside of the working width of printing machine 01 with respect to axial direction A. The threading path in the region of printing section 226 of the transport path provided for printing substrate 02 is preferably curved in precisely one direction.

At least one printing substrate web 02 preferably is and/or can be connected via at least one connecting element, more preferably embodied as at least one threading tip, to the at least one threading means, in particular regardless of whether the at least one threading means is embodied as a threading belt and/or a threading chain and/or as a continuous threading means and/or a finite threading means. The threading means is preferably different from any printing substrate 02.

The at least one threading means is preferably embodied as at least one continuous threading means, for example as at least one continuous threading belt. Alternatively, the at least one threading means is embodied as at least one finite threading means, for example as a finite threading belt and/or as a finite threading chain. At least one threading drive is preferably provided, which can be used for moving the at least one threading means along the at least one threading path. In the case of a continuous threading means, it is sufficient for precisely one such threading drive to be provided, for example. Alternatively, the at least one threading means may be embodied as finite. In that case, at least one threading storage unit is provided, in which the at least one threading means can be at least temporarily arranged, in particular as long as it is not being used for threading a printing substrate web 02. In an alternative embodiment, the at least one threading means is embodied as at least one finite threading chain. In the preferred case of the at least one continuous threading means, the at least one threading means for threading in a printing substrate web 02 along the provided transport path of printing substrate web 02 is preferably arranged, in particular permanently, along its at least one threading path within printing machine 01.

At least one threading guide element is preferably provided, by means of which at least one threading path of the at least one threading means can be and/or is defined. The at least one threading guide element is embodied, for example, as at least one turning roller. Alternatively, the at least one threading guide element is embodied as at least one chain guide. Preferably, the at least one threading guide element is embodied as at least one rotatable threading guide element, for example as at least one turning roller. A chain guide, in particular, can also have shunts for achieving different threading paths.

During pivoting movements of guide elements 241 and/or of the at least one support frame 276, the at least one threading guide element preferably remains immovable relative to stand 283. For threading in printing substrate web 02, for example, the guide elements 241 and/or the at least one support frame 276 are pivoted at least slightly, in particular by at least 3° and/or at most 15°, out of their working position to facilitate threading of the material web 02, specifically by thereby increasing the distance between print heads 221 and guide elements 241. For severing the material web 02, for example, the guide elements 241 and/or the at least one support frame 276 can be and/or are arranged in a cutting position, in which a relative situation that is particularly favorable for a cutting process is ensured between the first web fixing device 294 and the second web fixing device 296. For example, the guide elements 241 and/or the at least one support frame 276 for connecting ends of the material webs 02 can be and/or are arranged in a connecting position in which a relative situation that is particularly favorable for a connecting process, in particular a splicing process, between the first web fixing device 294 and the second web fixing device 296 is ensured. When the guide elements 241 and/or the support frame 276 are arranged in their working position, each element of the material web 02 is preferably arranged spaced from the first web fixing device 294 and/or from the second web fixing device 296 and/or from the connecting aid and/or from the contact surfaces. This preferably results in an avoidance of friction between these components and the material web 02.

During a regular printing operation, all print heads 221 are immovably arranged. This serves to ensure a consistently true-to-registration and/or true-to-register alignment of all nozzles. Various situations are conceivable in which a movement of print heads 221 might be necessary. A first such situation is a flying roll change or printing substrate change or generally a roll change involving a splicing process or a printing substrate change involving a splicing process. In that case, one printing substrate web 02 is connected to another printing substrate web 02 by means of an adhesive strip. This results in a connection point, which must pass through the entire transport path of the printing substrate web 02. The thickness, that is to say the smallest dimension of said connection point is greater than the thickness of the printing substrate web 02. Depending on the type of adhesion, the connection point has the same thickness as the printing substrate web 02 plus the adhesive strip or even the same thickness as two printing substrate webs 02 plus the adhesive strip. This can cause difficulties when the connection point passes through the gap between the nozzles of print heads 221 and the guide elements 241 of printing line 224.

At least the print heads 221 and preferably the at least one nozzle bar 231 as a whole can thus be moved in at least one direction relative to the guide plane of the first printing substrate guiding unit 249, in particular thrown off from said guide plane, more preferably orthogonally to a surface of the transport path provided for printing substrate 02 that is closest to print head 221. Preferably the print heads 221, and more preferably the at least one nozzle bar 231, can be moved, in particular, in at least one direction, each relative to the next closest element 241, in particular can be thrown off of it. In this way, the spacing can be increased sufficiently; however, it must be decreased again accordingly afterward. A second such situation arises, for example, during the maintenance and/or cleaning of at least one of print heads 221. Print heads 221 are preferably secured individually to the at least one nozzle bar 231 and can be individually removed from the at least one nozzle bar 231. This allows individual print heads 221 to be serviced and/or cleaned and/or replaced.

At least one cleaning device, in particular at least one nozzle cleaning device is preferably provided, which has at least one washing nozzle and/or at least one brush and/or at least one squeegee and/or at least one cleaning fleece. Print heads 221 are preferably arranged far enough from guide elements 241 of printing line 224, arranged in particular in their working positions, that the at least one cleaning device, in particular the nozzle cleaning device, fits into a resulting cleaning gap 289. Said at least one cleaning device is preferably arranged so as to move in transverse direction A, and more preferably, its dimension in transverse direction A is smaller than the working width of the printing machine. The at least one cleaning device is preferably arranged outside of the working width of the printing machine with respect to transverse direction A, when the print heads 221 assigned to said cleaning device are arranged in their printing position. Preferably, a separate cleaning device is assigned to each print head row 222 or each double row 223 of print heads 221.

At least one sensor embodied as a first printed image sensor is preferably provided, more preferably at a location along the transport path of printing substrate web 02 downstream of the last printing position of the at least one first printing assembly 200. The at least one first printed image sensor is embodied, for example, as a first line camera or as a first surface camera. The at least one first printed image sensor is embodied, for example, as at least one CCD sensor and/or as at least one CMOS sensor. The actuation of all the print heads 221 and/or double rows 223 of print heads 221 of the at least one first printing assembly 200, arranged and/or acting in succession in the conveying direction of the first printing substrate guiding unit 249, is preferably monitored and controlled by means of said at least one first printed image sensor and a corresponding analysis unit, for example the higher-level machine controller. In a first embodiment of the at least one printed image sensor, only a first printed image sensor is provided, the sensor field of which encompasses the entire width of the transport path of printing substrate web 02. In a second embodiment of the at least one printed image sensor, only a first printed image sensor is provided, however it is embodied as movable in direction A, orthogonally to the direction of the transport path of printing substrate web 02. In a third embodiment of the at least one printed image sensor, a plurality of printed image sensors are provided, the respective sensor fields of which each encompass different regions of the transport path of printing substrate web 02. These regions are preferably arranged offset from one another in direction A, orthogonally to the direction of the transport path of printing substrate web 02. All of the sensor fields of the plurality of printed image sensors combined preferably make up one entire width of the transport path of printing substrate web 02.

The positioning of pixels formed by printing ink droplets, each of which emerges from a respective first print head 221, is preferably compared with the positioning of pixels formed by printing ink droplets, each of which emerges from a respective second print head 221 situated downstream of the respective first print head 221 in the direction of conveyance of the first printing substrate guiding unit 249. This is preferably carried out regardless of whether said respective first and second print heads 221, which are arranged and/or act in succession in the direction of conveyance of the first printing substrate guiding unit 249, are processing the same or different printing fluids. The correlation of the positions of the printed images coming from different print heads 221 is monitored. If the same printing inks are being used, the true-to-register joining of partial images is monitored. If different printing inks are being used, the color-to-color registration or color register is monitored. Quality control of the printed image is also preferably carried out based on the measured values of the at least one printed image sensor.

Preferably, along the transport path provided for printing substrate 02, downstream of the at least one first printing assembly 200, at least one first dryer 301 is provided, which includes a region of the transport path provided for printing substrate 02 and embodied as a drying section, which is defined by an area of action of the at least one dryer 301. Once it has passed through the at least one first printing assembly 200, the transport path of printing substrate 02 and particularly of printing substrate web 02 preferably passes through the at least one first dryer 301, where the applied printing fluid is dried. The at least one first dryer 301 is preferably a component of a dryer unit 300.

Once printing substrate web 02 has passed the at least one first printing assembly 200, printing substrate web 02 is transported further along its transport path and is preferably fed to the at least one first dryer 301 of the at least one dryer unit 300. Preferably, a transport path for printing substrate 02 comprising one or more guiding and/or conveying means is formed downstream of the last printing position 201 such that the first side of the printing substrate web 02, which is imprinted in the at least one first printing assembly 200, does not come into physical contact with any component of the web-fed printing machine 01, in particular with any guiding and/or conveying means, between the time said printing substrate web passes the last printing position 201 and the time it enters the processing area of the at least one first dryer 301. The second side of the printing substrate web 02, which is not imprinted by the first printing assembly 200, preferably is in contact with at least one web guiding means 257, for example at least one web guiding roller 254; 256; 257, between the time said printing substrate web passes the last printing position 201 and the time it enters the processing area of the at least one first dryer 301.

The transport direction provided for printing substrate 02 preferably has at least one vertical, preferably downward pointing component that is greater than any horizontal component of said transport direction, over at least one-half, and more preferably at least 75% of the entire drying section. For this purpose, a motorized web guiding roller 254 is preferably provided, which is wrapped by printing substrate web 02 and/or the provided transport path at a wrap angle of preferably at least 45°, more preferably at least 60° and even more preferably at least 75°. Said at least one motorized web guiding roller 254 is preferably located along printing substrate 02 and/or the provided transport path downstream of the last guide elements of printing line 224 and upstream of the area of action of the at least one dryer 301.

The at least one first dryer 301 is preferably embodied as an infrared radiation dryer 301. The at least one first dryer 301 preferably has at least one radiation source, preferably embodied as an infrared radiation source. A radiation source, preferably an infrared radiation source, in this case is a device by means of which energy, in particular electrical energy, is and/or can be converted into radiation, preferably infrared radiation, and is and/or can be directed onto printing substrate web 02. The at least one radiation source preferably has a defined area of action. The area of action of a radiation source is particularly the area that contains every point that can be connected, in particular directly in a straight line and without interruption or via reflectors, to the radiation source. The area of action of the at least one first dryer 301 is composed of the areas of action of all the radiation sources of the at least one first dryer 301. The area of action of the at least one first dryer 301 preferably points from the at least one radiation source to a part of the transport path of printing substrate web 02 that is closest to the at least one radiation source. Air is introduced into the interior of the at least one first dryer 301 through at least one ventilation opening. Inside first dryer 301, water and/or solvent from the printing inks to be removed from printing substrate web 02 is removed by means of the infrared radiation and is absorbed by the introduced air. This air is then removed from the at least one first dryer 301 through at least one venting opening.

At least one first cooling device is preferably arranged downstream of the area of action of the at least one radiation source of the at least one first dryer 301 in the direction of transport of printing substrate web 02. The at least one first cooling device preferably has at least one first cooling roller and preferably a first cooling pressure roller that can be and/or is thrown onto the at least one first cooling roller, and preferably also has at least one deflecting roller that can be and/or is thrown onto the at least one first cooling roller.

Along the transport path of printing substrate web 02, downstream of outfeed nip and/or downstream of a rewetting unit, at least one post-processing device is arranged, which is preferably embodied as a single-stage or multi-stage folding apparatus, and/or has a sheet cutter and/or a planar delivery unit, or is embodied as a winding apparatus. In and/or by means of this post-processing device, printing substrate web 02 is preferably folded and/or cut and/or stitched and/or sorted and/or inserted and/or transported and/or wound.

The working width of printing machine 01 and/or of the at least one first printing assembly 200 and/or the width of a printing substrate 02 to be processed is, for example, at least 1500 mm, preferably at least 2000 mm and more preferably at least 2500 mm. However, even greater working widths and/or web widths can be enabled by means of the arranged guide elements 241, in particular in conjunction with the arranged inner support elements 274. The extension of guide elements 241 in the transverse direction is preferably at least as great as the working width of printing machine 01 and/or of the at least one first printing assembly 200, and more preferably is at least 2 cm greater and even more preferably at least 5 cm greater, to allow guide elements 241 to be secured in mounting devices 271.

In one embodiment of the at least one first printing assembly 200, a contact surface of each guide element 241, which is intended to contact printing substrate 02, is arranged higher at its center region, with respect to transverse direction Q, than the two outer ends of said contact surface, with respect to transverse direction Q. Particularly when combined with the convex curvature of the printing section of the transport path, this results in a longer transport path for printing substrate 02 in the center region than at the outer ends. As a result, printing substrate 02 is pulled outward in the transverse direction during its transport and is thereby stretched. This preferably leads to a decrease in undesirable rippling and vibrations of printing substrate 02. At least one guide element 241, for example, and preferably a plurality or more preferably all of guide elements 241 that define the printing section of the transport path provided for printing substrate 02 are convexly curved in transverse direction A. For this purpose, at least one raised inner support element is provided for each guide element 241, for example, or an inner support element 274 that is common to a plurality or all of guide elements 241 is preferably arranged in a raised position, in particular relative to lateral support elements 273 and/or in particular with respect to each of bearing regions 278. Variable raised positioning and thus sagging is possible, but preferably is not necessary. Alternatively, guide elements 241 may themselves be correspondingly shaped, for example as having a thicker cross-section at the center than at the outside, rather than sagging elastically. Preferably, however, all of print heads 221 are arranged at a substantially equal distance from the provided transport path. For example, they may be arranged in a corresponding arc on a mounting element and/or a mounting element that supports print heads 21 may itself be curved, in particular similarly to the corresponding guide elements 241.

While preferred embodiments of a printing assembly, in accordance with the present invention, have been set forth fully and completely hereinabove, it will be apparent to one of skill in the art that various changes could be made without departing from the true spirit and scope of the present invention which is accordingly to be limited only by the appended claims.

The invention claimed is:

1. A printing assembly (200), wherein the printing assembly (200) has at least two print heads (221), by means of each of which application positions (211) for printing fluid are specified, and wherein a transport path provided for printing substrate (02) through the printing assembly (200) is defined by at least two guide elements (241) of the printing assembly (200), and wherein a printing section (226) of the transport path provided for printing substrate (02) begins at a first application position (211) in the printing assembly (200) along said provided transport path and ends at a last application position (211) in the printing assembly (200) along said provided transport path, and wherein a transverse direction (A) is a horizontal direction (A), oriented orthogonally to the transport path provided for printing substrate (02) through the at least one printing assembly (200), characterized in that at least one of the at least two guide elements (241) that together define said provided transport path in the region of the printing section (226) is in contact with a total of at least two lateral support elements (273) and at least one inner support element (274) at three points that are spaced from one another in the transverse direction (A), the position of said guide element being thereby defined, and in that the at least two lateral support elements (273) are embodied as part of at least one support frame (276), and in that the at least one support frame (276) has at least one cross-member (277) that is different from the guide elements (241), which extends at least in the transverse direction (A) and ensures a constant relative positioning of the lateral support elements (273).

2. The printing assembly according to claim 1, characterized in that the at least one inner support element (274) is arranged such that it is and/or can be rigidly connected to at least one of the at least two lateral support elements (273) or in that the at least one inner support element (274) is arranged such that it is and/or can be rigidly connected to the at least two lateral support elements (273).

3. The printing assembly according to claim 1, characterized in that the at least one cross-member (277) that is different from the guide elements (241) ensures a constant relative positioning of the lateral support elements (273) and of the at least one inner support element (274), or the at least two cross-members (277) that are different from the guide elements (241) ensure a constant relative positioning of the lateral support elements (273) and of the at least one inner support element (274).

4. The printing assembly according to claim 1, characterized in that the at least one inner support element (274) is arranged such that it is and/or can be rigidly connected via at least one bracing element (277) to at least one of the at least two lateral support elements (273).

5. The printing assembly according to claim 4, characterized in that the at least one bracing element (277) is embodied as a cross-member (277), which is arranged in contact at least with the at least two lateral support elements (273).

6. The printing assembly according to claim 1, characterized in that the guide elements (241) that together define said transport path in the region of the printing section (226) each have a radially symmetrical cross-section over more than one-half of their extension in the transverse direction (A), and/or in that an outer surface (228) of each of the at least two guide elements (241) that together define said transport path in the region of the printing section (226) is formed in the shape of a cylindrical shell, at least within a working region of the printing assembly (200).

7. The printing assembly according to claim 1, characterized in that the at least two print heads (221) are embodied as print heads (221) configured for a non-impact printing process, and/or in that the at least two print heads (221) are embodied as inkjet print heads (221), and/or in that the at least one inner support element (274) is in contact at one point with the at least one guide element (241) that contributes to defining said transport path in the region of the printing section (226), the positioning of said guide element with respect to the transverse direction (A) coinciding with the positioning of at least one nozzle of at least one print head (221) of the printing assembly (200).

8. The printing assembly according to claim 1, characterized in that the at least two guide elements (241) that together define said transport path in the region of the printing section (226) are stationary guide elements (241) with respect to rotational movements or pivoting movements about axes other than at least one pivot axis (281; 282) that is common to them and/or are stationary guide elements (241) relative to at least one support element (273; 274) that supports said at least two guide elements (241).

9. The printing assembly according to claim 1, characterized in that at least five stationary guide elements (241) that together define the provided transport path are arranged one in front of the other along the printing section (226) of said provided transport path.

10. The printing assembly according to claim 1, characterized in that the at least two guide elements (241) that together define said transport path in the region of the printing section (226) each have a turning angle of at least 0.5° and at most 5° with respect to the transport path provided for printing substrate (02).

11. The printing assembly according to claim 1, characterized in that said at least two guide elements (241) that together define said provided transport path in the region of the printing section (226) are arranged so as to pivot about at least one pivot axis (281; 282) that is common to them.

12. The printing assembly according to claim 1, characterized in that at least one threading means that is movable along at least one threading path for threading in a printing substrate web (02) is and/or can be arranged, at least intermittently, within the at least one printing assembly (200).

13. The printing assembly according to claim 1, characterized in that a main conveying direction (B) is defined by a rectilinear connection between a first guide element (241) with respect to the printing section (226) of the transport path provided for printing substrate (02), which guide element contributes to defining said transport path in the region of the printing section (226), and a last guide element (241) with respect to the printing section (226) of the transport path provided for printing substrate (02), which guide element contributes to defining said transport path in the region of the printing section (226), and in that, when the guide elements (241) that together define said transport path in the region of the printing section (226) are in their maintenance position, the main conveying direction (B) is arranged at a maximum angle of 30° in relation to a vertical direction.

14. A printing machine (01), wherein the printing machine (01) has at least a first printing assembly (200) according to claim 1.

15. The printing machine according to claim 14, characterized in that, along the transport path provided for printing substrate (02), downstream of the at least one first printing assembly (200), at least one first dryer (301) is arranged, which has a region of the transport path provided for printing substrate (02), embodied as a drying section, which is defined by an area of action of the at least one dryer (301), and in that in at least one-half of the drying section as a whole, a transport direction provided for the printing substrate (02) has at least one vertical component that is greater than any horizontal component of said transport direction that may be present, and/or in that the printing machine (01) is embodied as a web-fed printing machine (01) and/or has at least one roll unwinding device.

* * * * *